US012295450B2

(12) United States Patent
Kajiwara et al.

(10) Patent No.: US 12,295,450 B2
(45) Date of Patent: May 13, 2025

(54) SOLE FOR A SHOE

(71) Applicant: MIZUNO Corporation, Osaka (JP)

(72) Inventors: Yo Kajiwara, Osaka (JP); Yohei Yoshida, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 53 days.

(21) Appl. No.: 18/085,823

(22) Filed: Dec. 21, 2022

(65) Prior Publication Data

US 2023/0200485 A1 Jun. 29, 2023

(30) Foreign Application Priority Data

Dec. 26, 2021 (JP) ..... 2021-211752

(51) Int. Cl.

| | |
|---|---|
| ***A43B 13/40*** | (2006.01) |
| ***A43B 3/26*** | (2006.01) |
| ***A43B 7/1425*** | (2022.01) |
| ***A43B 13/12*** | (2006.01) |
| ***A43B 13/18*** | (2006.01) |
| ***A43B 13/37*** | (2006.01) |
| ***A43B 13/38*** | (2006.01) |

(52) U.S. Cl.

CPC ..... *A43B 13/125* (2013.01); *A43B 3/26* (2013.01); *A43B 7/1425* (2013.01); *A43B 13/181* (2013.01); *A43B 13/37* (2013.01); *A43B 13/386* (2013.01); *A43B 13/40* (2013.01)

(58) Field of Classification Search

CPC ..... A43B 3/26; A43B 7/1465; A43B 13/386; A43B 13/40; A43B 17/0006; A43B 7/1425

USPC ..... 36/25 R

See application file for complete search history.

(56) References Cited

U.S. PATENT DOCUMENTS

| | | | | |
|---|---|---|---|---|
| 10,448,704 | B2 * | 10/2019 | Dupre | A43B 13/12 |
| 2009/0151201 | A1 * | 6/2009 | Lee | A43B 21/26 36/76 R |
| 2009/0183393 | A1 * | 7/2009 | Lee | A43B 21/28 36/43 |
| 2017/0095033 | A1 * | 4/2017 | Farina | A43B 7/18 |
| 2017/0095034 | A1 * | 4/2017 | Dupre | A43B 13/141 |
| 2017/0245586 | A1 * | 8/2017 | Cook | A43D 1/02 |
| 2019/0365033 | A1 * | 12/2019 | Chambers | A43B 13/026 |
| 2020/0305543 | A1 * | 10/2020 | Kajiwara | A43B 13/023 |

(Continued)

FOREIGN PATENT DOCUMENTS

| | | | |
|---|---|---|---|
| JP | S63131608 | A | 6/1988 |
| JP | 2006305310 | A | 11/2006 |

(Continued)

*Primary Examiner* — Marie D Bays

(74) *Attorney, Agent, or Firm* — CANTOR COLBURN LLP

(57) ABSTRACT

A sole for a shoe includes a sole body extending longitudinally from a heel portion to a toe portion and a curved plate provided at the sole body and extending longitudinally along the sole body. A compressive rigidity of the sole body is lowest at a metatarsophalangeal joint position. The sole body includes a sole forefoot top part disposed above the curved plate at the forefoot portion and a sole forefoot bottom part disposed below the curved plate at the forefoot portion. The compressive rigidity of the sole body is relatively low at the sole forefoot bottom part.

6 Claims, 25 Drawing Sheets

(56) References Cited

U.S. PATENT DOCUMENTS

| | | | | |
|---|---|---|---|---|
| 2021/0037911 | A1* | 2/2021 | Paulson | A43B 13/127 |
| 2021/0169173 | A1* | 6/2021 | Oleson | B33Y 80/00 |
| 2021/0204651 | A1* | 7/2021 | Thompson | A43B 13/04 |
| 2022/0031016 | A1* | 2/2022 | Geis | A43B 13/141 |
| 2022/0104581 | A1* | 4/2022 | Sakaguchi | A43B 13/143 |
| 2022/0378145 | A1* | 12/2022 | Tateno | A43B 13/125 |
| 2023/0124653 | A1* | 4/2023 | Farina | A61H 1/0266 36/25 R |

FOREIGN PATENT DOCUMENTS

| | | | |
|---|---|---|---|
| JP | 2019533542 | A | 11/2019 |
| WO | 2018089721 | A1 | 5/2018 |

* cited by examiner

SOLE FOR A SHOE

BACKGROUND OF THE INVENTION

The present invention relates generally to a sole for a shoe, and more particularly, to an improved structure of the sole that urges a windlass action during loading and that enhances a supporting and elevating effect at the midfoot portion to the heel portion, thus improving a running efficiency.

Japanese patent application publication No. 2018-534028 discloses a sole structure incorporating a footwear plate therein (see FIGS. 2 to 3 of the publication). The sole structure (200) includes a buffer member (250) and the footwear plate (300) provided at the buffer member (250) and having a curved portion.

According to the above-mentioned publication, it describes that an energy loss at MTP joints is decreased during running and rotation of a foot is increased (see).

On the other hand, recently, when running efficiently in a long-distance race, a forefoot running style that impacts the ground at a forefoot region has become mainstream. Generally, in the forefoot running, a heel portion sinks (or falls/drops) downwardly immediately after a ground-contact at the forefoot region. At this juncture, a plate member like a footwear plate mentioned above may exhibit a certain degree of effect relative to such a sinking of the heel portion, However, with only such a footwear plate as stated in the above publication, a windlass action cannot be promoted and a running efficiency cannot be improved.

The present invention has been made in view of these circumstances and its object is to provide a sole for a shoe that urges a windlass action during loading, that enhances a supporting and elevating effect at a midfoot portion to a heel portion, and that improves a running efficiency.

Other objects and advantages of the present invention will be obvious and appear hereinafter.

SUMMARY OF THE INVENTION

A sole for a shoe according to the present invention incudes a heel portion, a midfoot portion and a forefoot portion. The sole comprises a sole body that extends longitudinally from the heel portion to a toe portion of the forefoot portion and a curved plate that is provided at the sole body and that extends longitudinally along the sole body. A compressive rigidity of the sole body is lowest at a metatarsophalangeal joint position of the forefoot position. Here, the term, "compressive rigidity" is a concept that expresses a resistance to deformation relative to a compressive load. When the same compressive load is applied, a sole of a high compressive rigidity undergoes a small amount of deformation, whereas a sole of a low compressive rigidity undergoes a large amount of deformation.

According to the present invention, since the compressive rigidity of the sole body is lowest at the metatarsophalangeal joint position, at the time of loading after a ground-contact at the forefoot portion of the sole, the forefoot portion deforms downwardly relatively largely (compared to the midfoot portion and the heel portion of the sole). As a result, toes are largely bent and a plantar aponeurosis is stretched, thereby elevating an arch, promoting a windlass action (that is, through bending of the toes, the arch is elevated to increase stiffness of a foot), and increasing a propulsion force during running. In this case, since the sole can promptly perform the windlass action at the time of impacting the ground at the forefoot portion of the sole, the timing for exerting the windlass action can be accelerated to correspond to a faster speed, thus increasing a running efficiency.

Furthermore, according to the present invention, since the curved plate is provided that extends longitudinally along the sole body, a drop (or fall) of the heel portion after impacting the ground at the forefoot portion of the sole is restrained by the curved plate, thus enabling the amount of drop (or fall) of the heel portion to decrease. At the same time, when an anterior side of the curved plate is pushed downwardly due to a load transfer in a forward direction, the curved plate acts to lift up a posterior side thereof. In conjunction with a relative deformation of the forefoot portion of the sole, a supporting and elevating effect of the sole can be enhanced at a midfoot region and a heel region of the foot, thus improving a running efficiency following an elevation of the arch.

Moreover, according to the present invention, by promoting the windlass action, a stiffness of the foot can be increased to improve stability, and a kick to the ground can be strengthened at the time of leaving the ground, thus further improving a running efficiency. Also, as the forefoot portion of the sole deforms downwardly relatively largely, a support angle relative to a foot sole, thereby further enhancing a supporting and elevating effect at the midfoot portion to the heel portion.

The sole body may include at least either a sole forefoot top part disposed above the curved plate at the forefoot portion or a sole forefoot bottom part disposed below the curved plate at the forefoot portion. That is, in this case, the sole body may include only the forefoot top part, only the forefoot bottom part, or both the sole forefoot top part and the forefoot bottom part. At the time of deformation of the forefoot portion of the sole, either the sole forefoot top part or the sole forefoot bottom part, alternatively, both the sole forefoot top part and the sole forefoot bottom part deform to sink downwardly relatively largely, compared to a deformation of the sole midfoot portion and the sole heel portion, such that thereby a windlass action is promoted and a propulsion force can be increased during running, thus enhancing a running efficiency.

The sole body may include the sole forefoot top part and the sole forefoot bottom part, and the sole forefoot top part and the sole forefoot bottom part may have one of the features selected from the group consisting of:

- a first feature wherein, a compressive rigidity of the sole forefoot top part and the sole forefoot bottom part is lower than a compressive rigidity at a region other than the sole forefoot top part and the sole forefoot bottom part;
- a second feature wherein, a compressive rigidity of the sole forefoot top part is lower than a compressive rigidity at a region (including the sole forefoot bottom part) other than the sole forefoot top part; and
- a third feature wherein, a compressive rigidity of the sole forefoot bottom part is lower than a compressive rigidity at a region (including the sole forefoot top part) other than the sole forefoot bottom part.

In this instance, the compressive rigidity of the sole forefoot top part and the sole forefoot bottom part is relatively lower, alternatively, the compressive rigidity of either the sole forefoot top part or the sole forefoot bottom part is relatively lower. In either case, at the time of loading after the ground contact at the sole forefoot portion, the sole forefoot portion deforms to sink downwardly relatively largely compared to the sole midfoot portion and the sole heel portion, such that thereby toes of the foot are largely bent and the plantar aponeurosis is stretched. As a result, the arch is elevated and the windlass action is thus promoted to increase the propulsion power during running and to enhance the running efficiency. Also, in the event that the compressive rigidity of the sole forefoot top part is relatively lower alone or along with the sole forefoot bottom part, a wearer's touch on the foot can be improved and a push-up or thrust feeling on a foot sole can be relived.

The curved plate may have a downwardly convexly curved part that curves in a downwardly convex shape from the forefoot portion to the midfoot portion, and a flat part that extends in a generally flat shape or an upwardly convexly curved part that curves gently in an upwardly convex shape from the midfoot portion to the heel portion.

The sole body may have a sole top surface and a sole bottom surface. A sole reference posture is defined as a sole posture, in which a reference line is set as a straight-line to connect a toe-tip position and a rearmost end position of the sole top surface, the rearmost end position is set to the origin, a path length measured along the sole top surface from the origin to the toe-tip position is set to L, an intersection point of the sole bottom surface and a line crossing a position of (0.45×L) from the origin along the sole top surface and orthogonal to the reference line is set to a ground-contact point, and the sole is in contact with the ground at the ground-contact point. In the sole reference posture, the sole bottom surface is separated from the ground at an anterior region from the metatarsophalangeal joint position of (0.68×L) from the origin along the sole top surface. Also, in the sole reference posture, an angle θ is greater than or equal to 5 degrees, in which the angle θ is set between the ground and a straight-line connecting a heel central position of (0.15×L) from the origin along the sole top surface with a metatarsophalangeal joint position of (0.68×L) from the origin along the sole top surface.

According to the present invention, the angle θ is set between the ground and the straight-line connecting the heel central position of (0.15×L) from the origin with the metatarsophalangeal joint position of (0.68×L) from the origin along the sole top surface, and an inequality, $0 \leq 5$ [degrees] is satisfied in the sole reference posture. Therefore, the sole heel portion can be disposed above the sole forefoot portion (that is, the sole 1 is placed in a heel-up posture) to enable the sole to coincide with a forefoot posture, thereby exhibiting a natural support effect by the sole bottom surface from the moment of the contact with ground, preventing an excessive sinking/drop of the heel portion at the time of a contact with the ground, thus allowing for a smooth transfer from the heel portion to the forefoot portion after the contact with the ground.

Additionally, in the event that there is a concave portion, a groove or the like formed at a position corresponding to the ground-contact point on the sole bottom surface, a virtual surface that smoothly connect longitudinally opposite opening ends of the concave portion, groove or the like is set as a virtual sole bottom surface and the ground-contact point is determined on the virtual sole bottom surface.

Here, the above-mentioned patent application publication No. 2018-534028 does not describe that the stiffness of the buffer member (250) is relatively lower on the sole forefoot-side and there are no descriptions in it in the light of promoting the windlass action.

As mentioned above, according to sole for the shoe of the present invention, it can urge a windlass action during loading and enhance a support and elevation effect at the midfoot portion to the heel portion, thus improving a running efficiency.

BRIEF DESCRIPTION OF THE DRAWINGS

For a more complete understanding of the invention, reference should be made to the embodiments illustrated in greater detail in the accompanying drawings and described below by way of examples of the invention.

DETAILED DESCRIPTION OF THE PREFERRED EMBODIMENTS

The present invention will now be described in detail with reference to embodiments thereof as illustrated in the accompanying drawings.

First Embodiment

Figure 1:
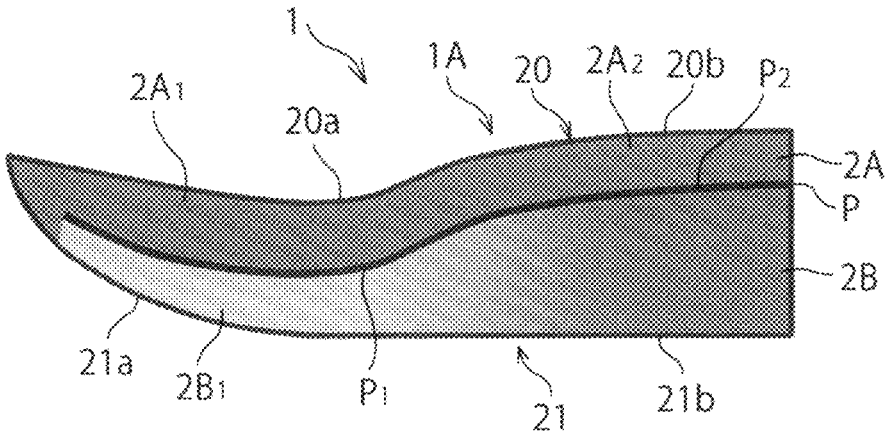
FIG. 1 is a side schematic view of a sole according to a first embodiment of the present invention.
Figure 2:
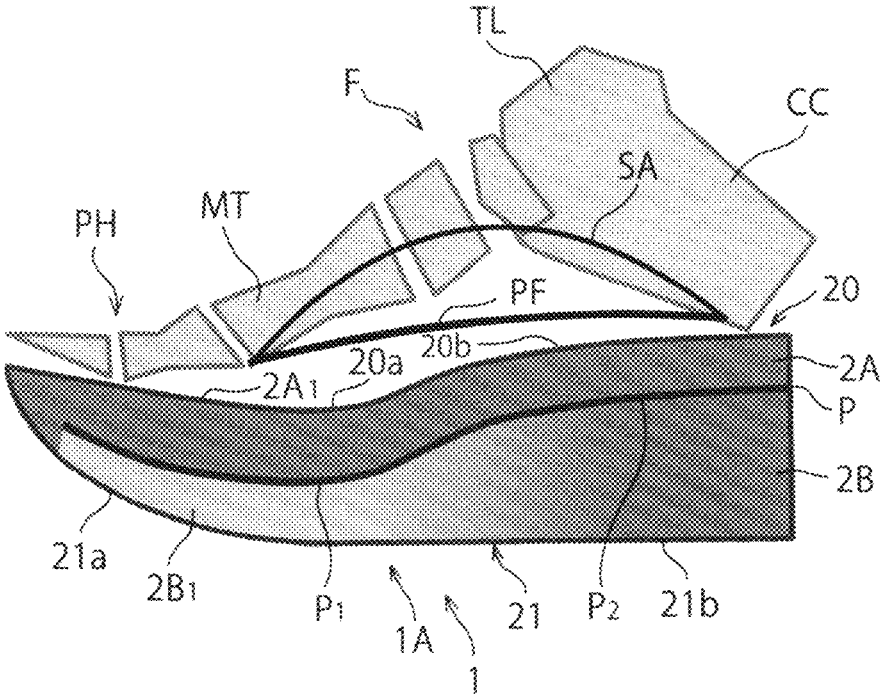
FIG. 2 shows the state of a foot skeleton and a plantar aponeurosis when a shoe wearer wears a shoe (an upper is not shown) incorporating the sole of FIG. 1.
Figure 3:
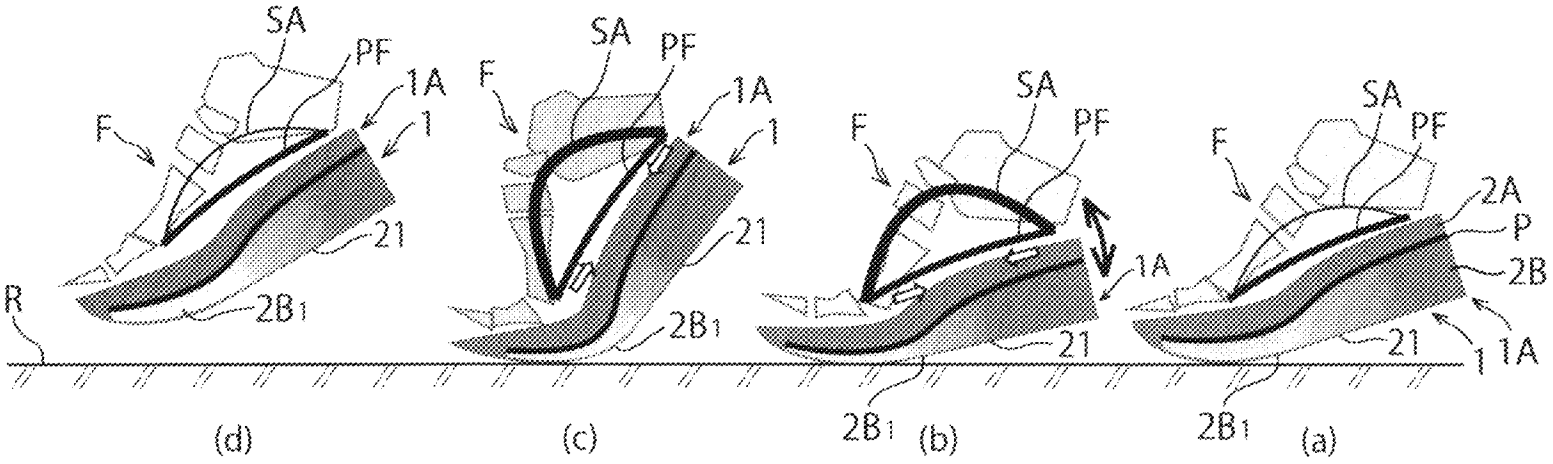
FIG. 3 shows the state of running of the shoe of FIG. 2, illustrating movements of the sole relative to the ground in the order from (a) to (d) in time-series manner
Figure 3A:
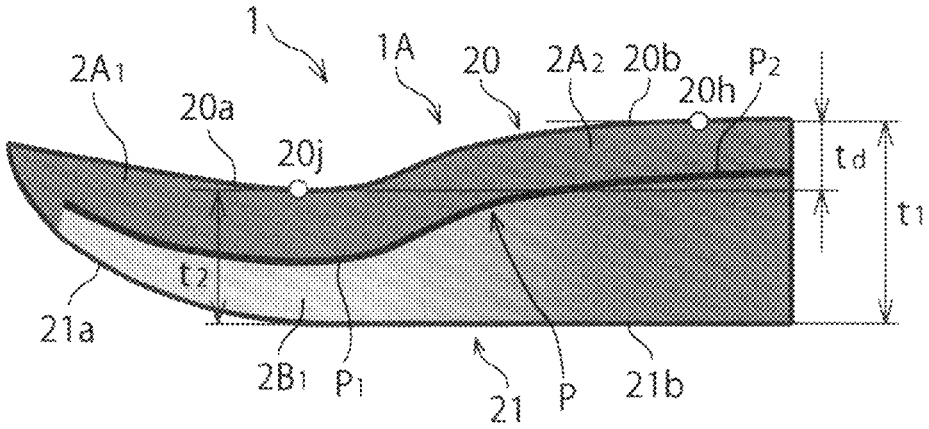
FIG. 3A shows a difference in height/thickness (i.e., a drop) between a heel portion and a forefoot portion of the sole of FIG. 1.
Figure 3B:
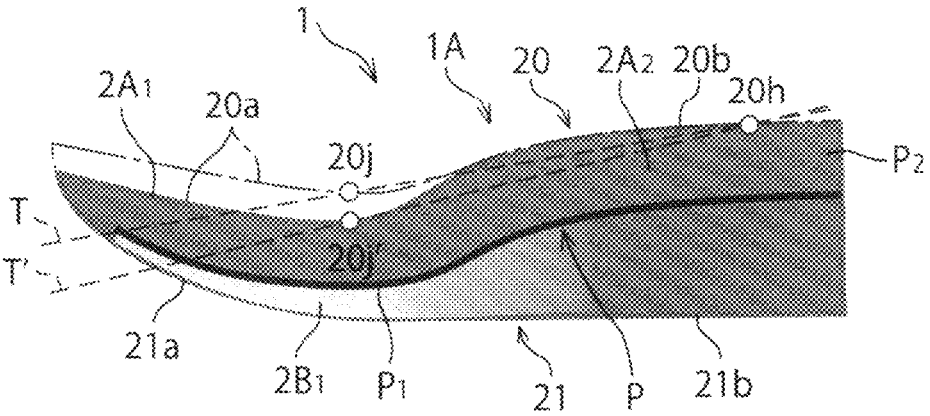
FIG. 3B shows a state of deformation when a maximum load is applied to the sole of FIG. 1.
Figure 3C:
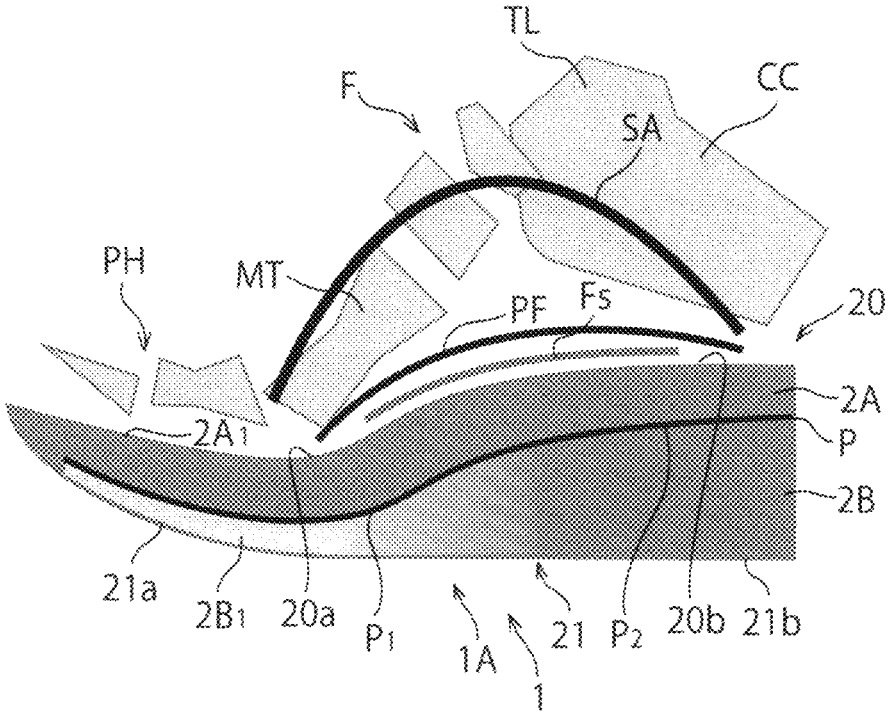
FIG. 3C shows a condition in which the midfoot portion relatively lifts up relative to the forefoot portion at the time of an action of the maximum load.
Figure 3D:
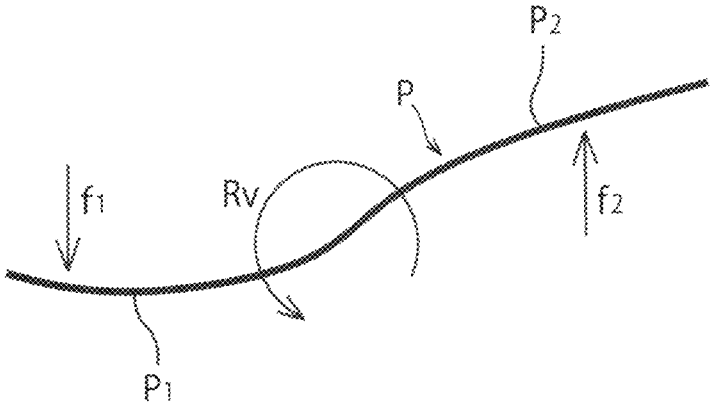
FIG. 3D is a side view of the curved plate showing its deformation when the load is transferred to the toe portion of the sole of FIG. 1.
Figure 3E:
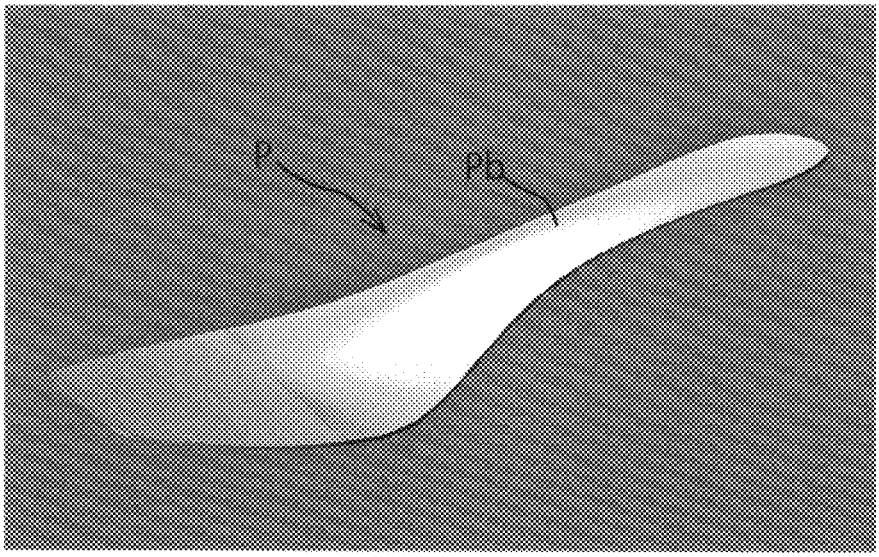
FIG. 3E is a general perspective view of the curved plate of FIG. 3D, as viewed from forwardly diagonally above.
Figure 3F:
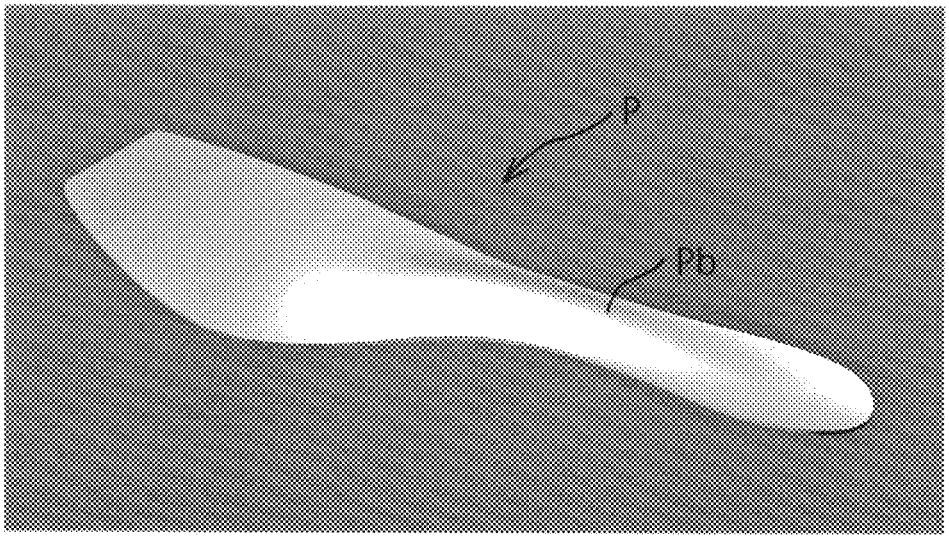
FIG. 3F is a general perspective view of the curved plate of FIG. 3D, as viewed from rearwardly diagonally above.
Figure 3G:
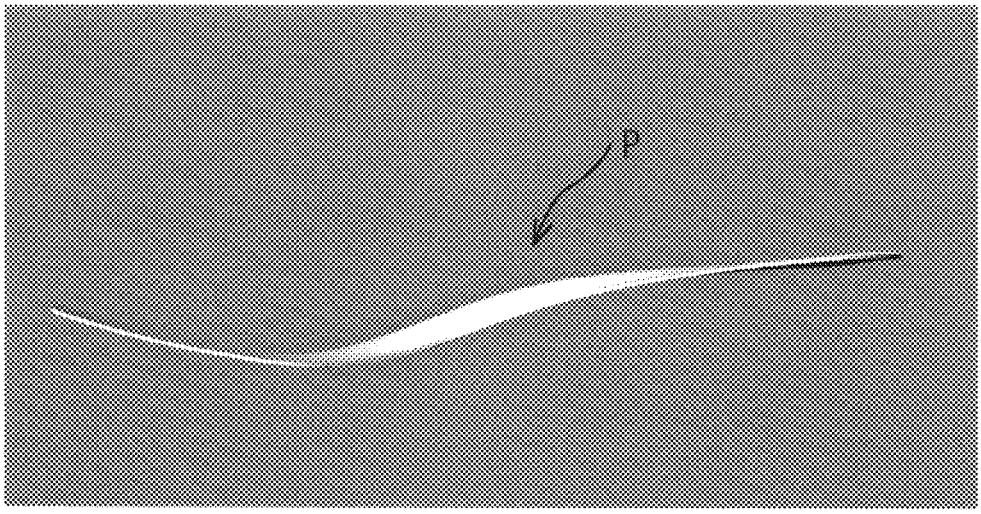
FIG. 3G is a side view of the curved plate of FIG. 3D.
Figure 3H:
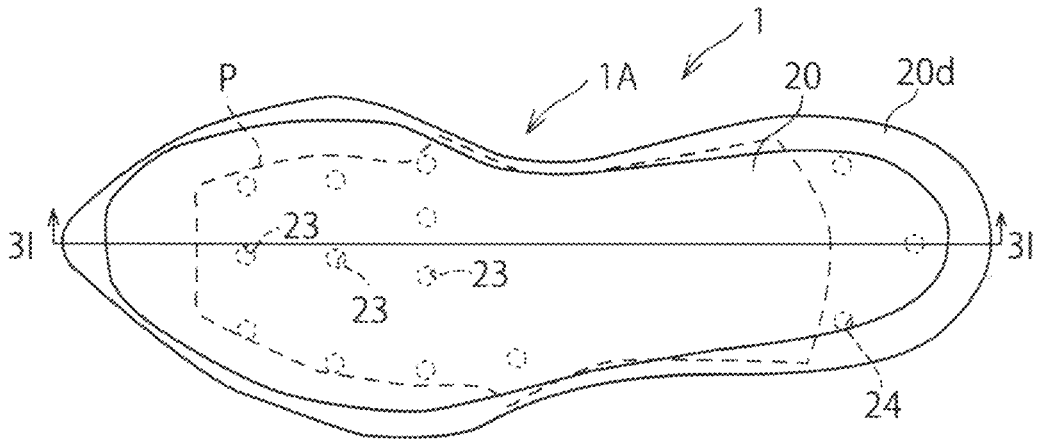
FIG. 3H is a top plan schematic view of the sole of FIG. 1.
Figure 3I:
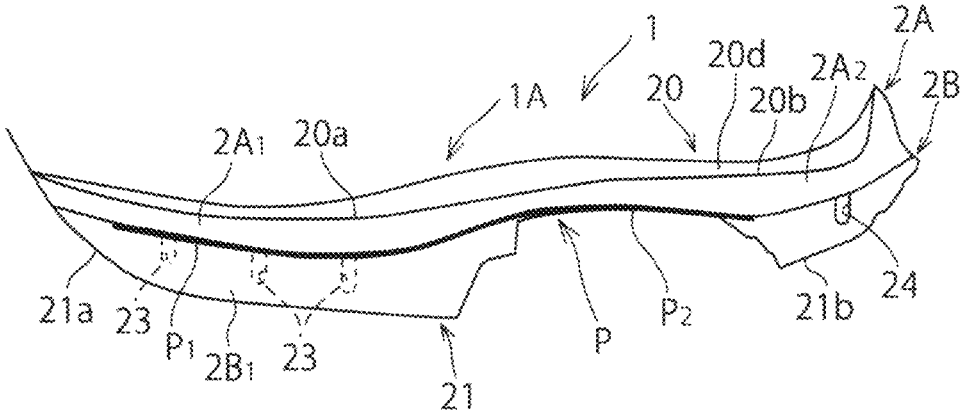
FIG. 3I is a longitudinal sectional schematic view of the sole of FIG. 3H taken along line 3I-3I.
Figure 3J:
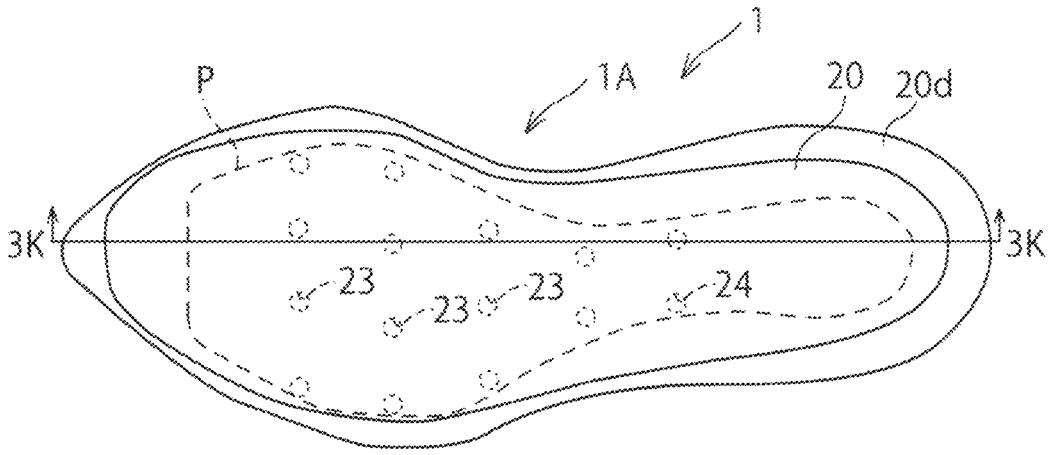
FIG. 3J is a top plan schematic view of a sole according to a first alternative embodiment of FIG. 3H.
Figure 3K:
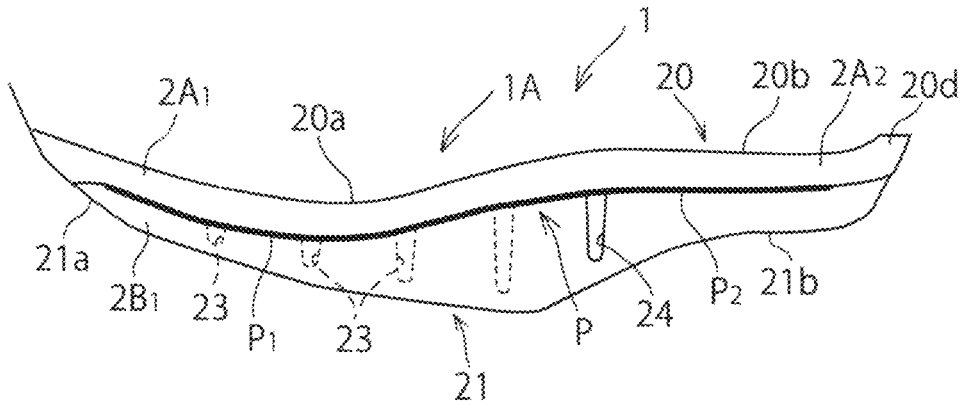
FIG. 3K is a longitudinal sectional schematic view of the sole of FIG. 3J taken along line 3K-3K.
Figure 3L:
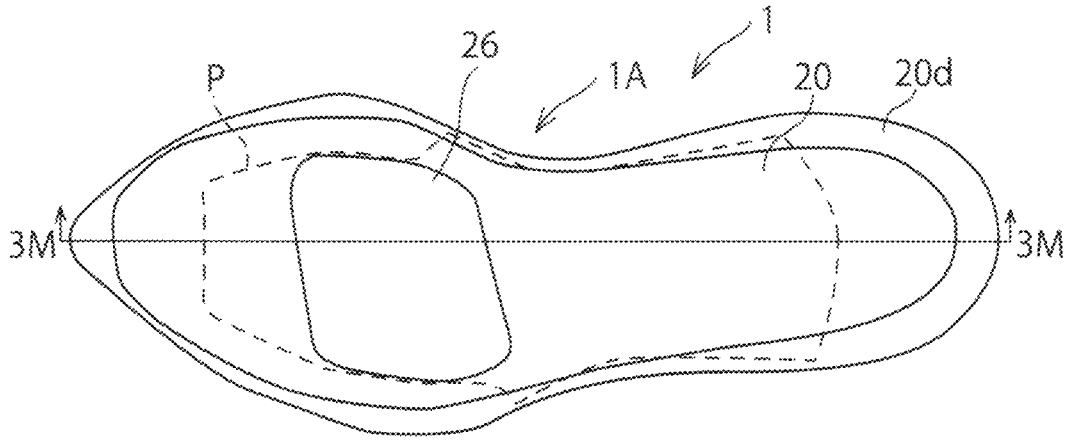
FIG. 3L is a top plan schematic view of a sole according to a second alternative embodiment of FIG. 3H.
Figure 3M:
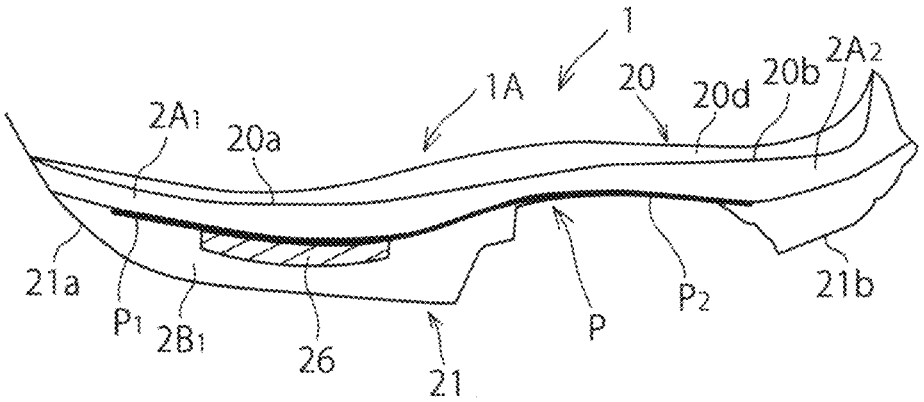
FIG. 3M is a longitudinal sectional schematic view of the sole of FIG. 3L taken along line 3M-3M.
Figure 3N:
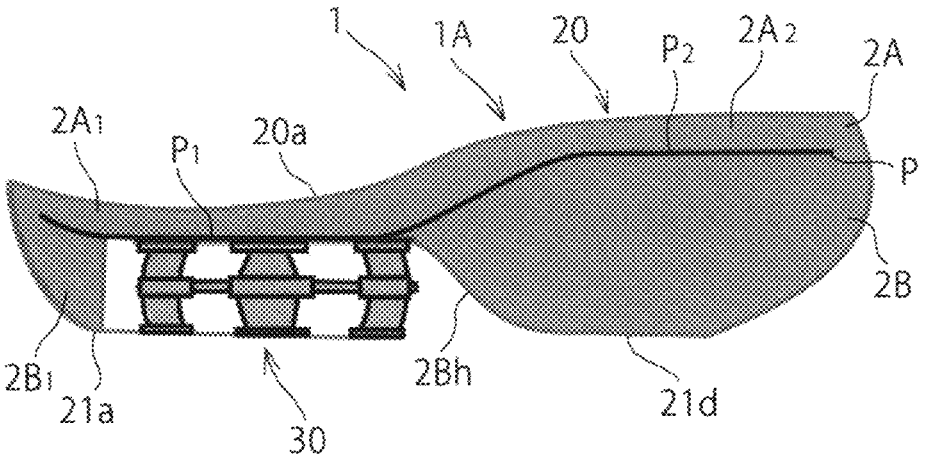
FIG. 3N is a longitudinal sectional schematic view of a sole according to a third alternative embodiment of FIG. 3H.
Figure 3O:
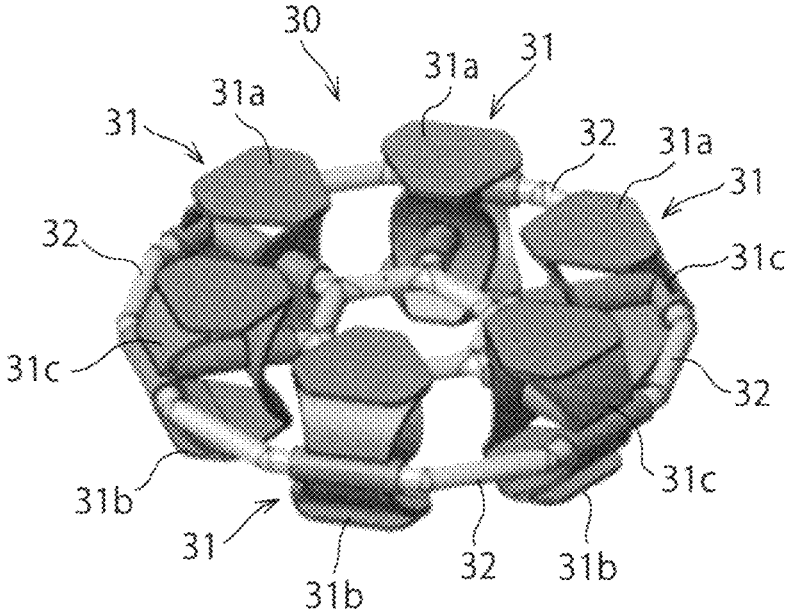
FIG. 3O is a general perspective view of a shock absorber in the sole of FIG. 3N.
Figure 3P:
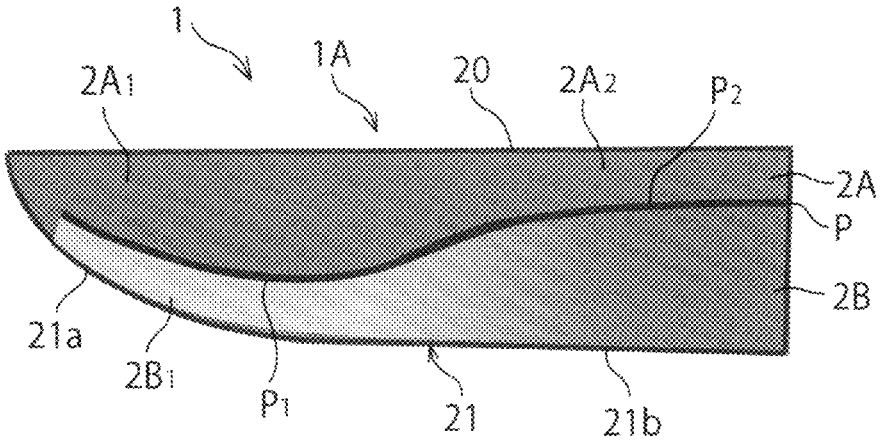
FIG. 3P is a side schematic view of a sole, in which a forefoot top part of the sole has a different shape from that of FIG. 1.
Figure 3Q:
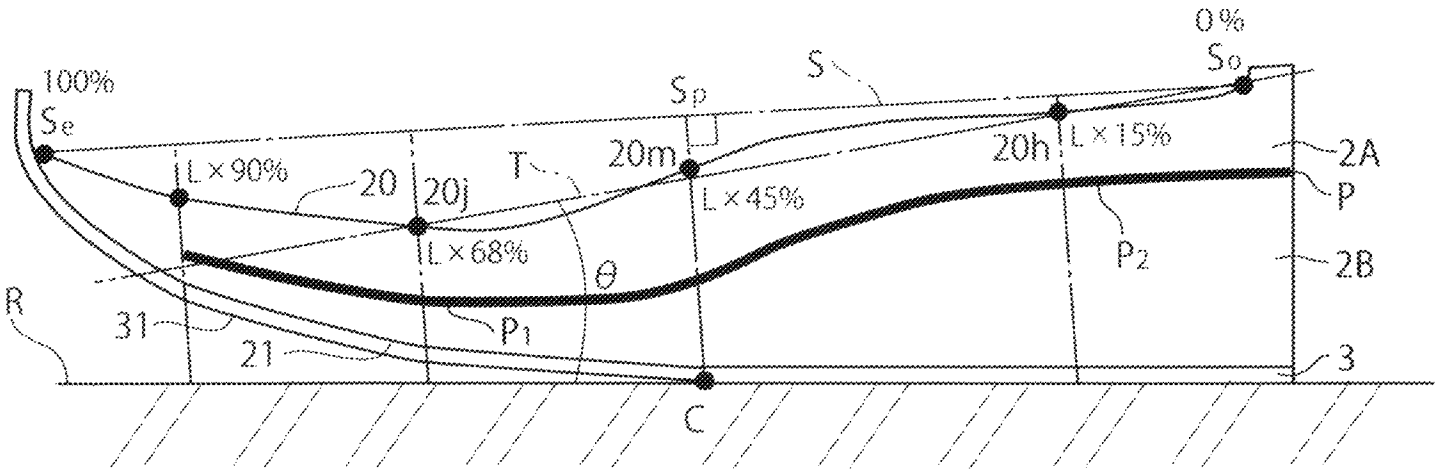
FIG. 3Q is a side view illustrating the details of the shape of the sole of FIG. 3P.

FIGS. 1 to 3Q show a sole of a shoe according to a first embodiment of the present invention. In these drawings, FIGS. 1 to 3C and 3P show side schematic views of the sole, FIGS. 3D to 3G show a curved plate, FIGS. 3H, 3J and 3L are top plan views of the sole, FIGS. 3I, 3K, 3M and 3N are longitudinal sectional views of the sole, FIG. 3O is a general perspective view of a shock absorbing member, and FIG. 3Q is a side view explaining the detailed shape of the sole. In FIGS. 3E to 3G, backgrounds are colored in grey for illustration purposes. Here, a sports shoe, especially a running shoe for a middle to long distance is taken for an example as a shoe.

In the following explanations, "upward (upper side/upper)" and "downward (lower side/lower)" designate an upward direction and a downward direction, or vertical direction, of a sole, respectively, "forward (front side/front)" and "rearward (rear side/rear)" designate a forward direction and a rearward direction, or longitudinal direction, of the sole, respectively, and "a width or lateral direction" designates a crosswise direction of the sole.

For example, in FIG. 1, a side schematic view of the shoe, "upward" and "downward" designate "upward" and "downward" in FIG. 1 respectively, "forward" and "rearward" designate "left and right directions" in FIG. 1 respectively and "a width direction" designates "out of the page" and "into the page" of FIG. 1.

As shown in FIG. 1, Sole 1 includes an upper midsole 2A disposed on the upper side thereof, a lower midsole 2B disposed below the upper midsole 2A, and a curved plate P sandwiched between the upper and lower midsoles 2B. That is, in this exemplification, the upper midsole 2A is disposed above the curved plate P and the lower midsole 3B is disposed below the curved plate P. The upper and lower midsoles 2A and 2B constitute a sole body 1A. A top surface 20 of the upper midsole 2A (i.e., a sole top surface 20) of the sole 1 forms a foot-sole-contact surface that contacts a foot sole of a shoe wearer directly or indirectly through an insole (not shown) or the like. A bottom surface 21 of the lower midsole 2B (i.e., a sole bottom surface 21 of the sole 1) forms a ground-contact surface that contacts the ground through an outsole (not shown).

The upper and lower midsoles 2A, 2B (that is, the sole body 1A) and the curved plate P extend longitudinally from a heel portion (or a right-end portion of FIG. 1) through a midfoot portion (or a substantially central portion of FIG. 1) to a toe portion of a forefoot portion (or a left-end portion of FIG. 1). The sole top surface 20 includes a downwardly concavely curved portion 20*a* at the forefoot portion and a gently upwardly convexly curved portion (alternatively, a generally flat portion) 20*b* at the midfoot portion to the heel portion.

A shape of the sole body 1A will be further explained below using FIG. 3A.

FIG. 3A shows the same sole as the sole 1 of FIG. 1. As shown in FIG. 3A, a rearmost end position (or a right end position of FIG. 3A) of the sole top surface 20 is set to the origin, a path length measured along the sole top surface 20 from the origin to the toe-tip position is set to L, a position of (0.15×L) from the origin along the sole top surface 20 is set to a heel central position 20*h*, and a position of (0.68×L) from the origin along the sole top surface 20 is set to a metatarsophalangeal (MP) joint position 20*j*. Here, when a thickness of the sole 1 at the heel central position 20*h* is set to $t_1$ and a thickness of the sole 1 at the metatarsophalangeal (MP) joint position 20*j* is set to $t_2$, an inequality, $t_1>t_2$ is satisfied. A difference ta between both the thicknesses $t_1$ and $t_2$, that is $t_1$-$t_2$, is called a "drop". In an example shown in FIG. 3A, the sole 1 has a drop ta. Also, in the example, a top surface 20*a* of the forefoot portion of the sole body 1A (or the sole forefoot portion), which is a top surface 20*a* of the sole forefoot top part $2A_1$ disposed above the curved plate P, is located at a position lowered than a top surface 20*b* of the midfoot portion of the sole body 1A (or the sole midfoot portion), which is a top surface 20*b* of the sole midfoot top part $2A_2$ disposed above the curved plate P.

Figure 20:
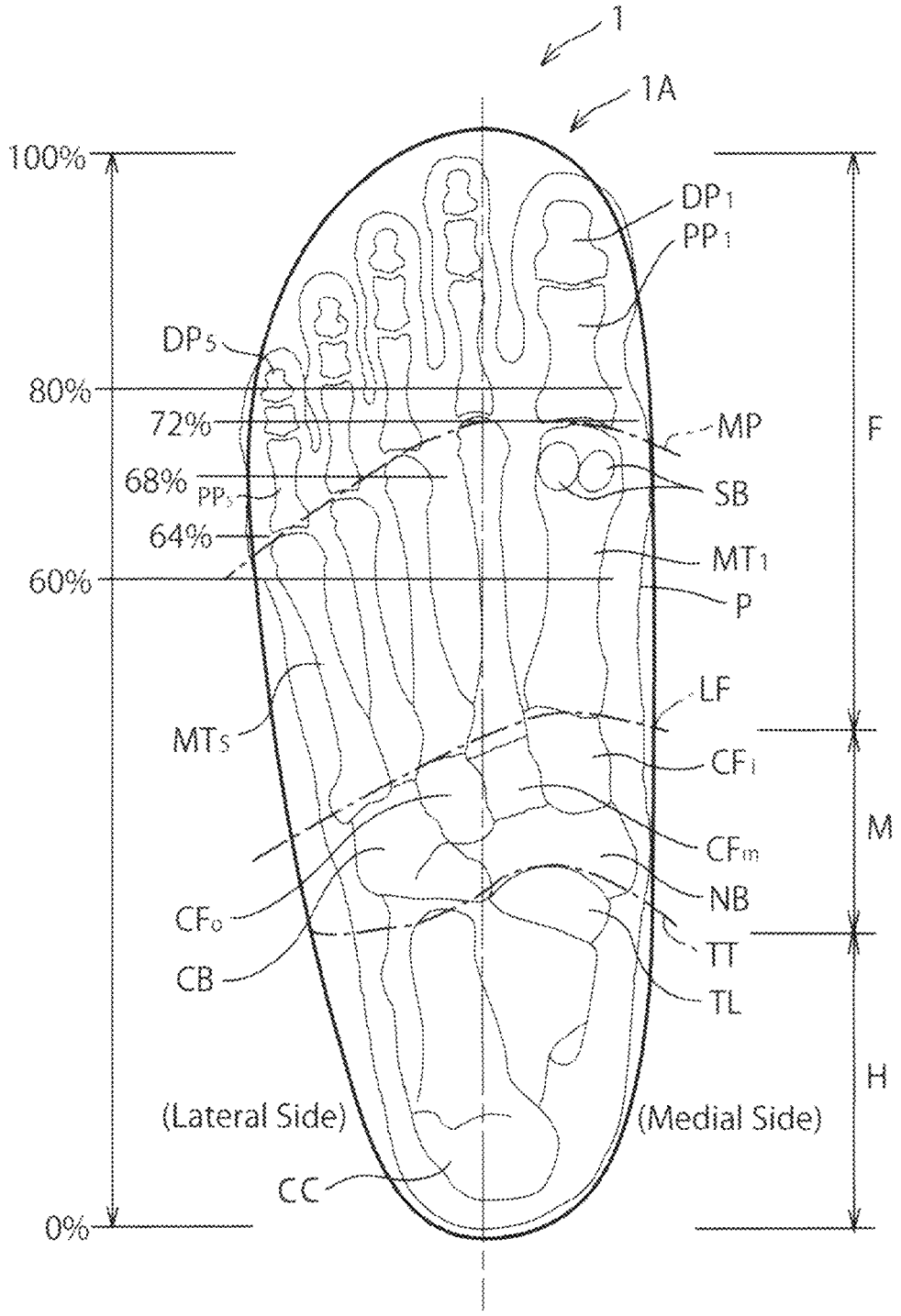
FIG. 20 is a view showing a positional relation between the sole of the present invention and a foot skeleton.

Here, FIG. 20 shows a positional relation between the sole body 1A and a skeleton structure of a right foot P of a shoe wearer, as viewed from a bottom side of the foot. In the drawing, reference characters $DP_1$, $PP_1$, $MT_1$, and SB indicate a distal phalanx, a proximal phalanx, a metatarsus of a first toe, and a sesamoid bone, respectively. Reference characters $DP_5$, $PP_5$, $MT_5$ indicate a distal phalanx, a proximal phalanx, a metatarsus of a fifth toe, respectively. Reference characters CC, TL, CB, NB, CF indicate a calcaneus, a talus, a cuboid bone, a navicular bone, a cuneiform bone, respectively. The cuneiform bone CF is formed of a medial cuneiform bone $CF_1$, an intermediate cuneiform bone $CF_m$, a lateral cuneiform bone $CF_o$, which are disposed in the order from the medial side to the lateral side. Also, reference characters MP, LF, TT designate a metatarsophalangeal joint, a Lisfranc joint, a Chopart joint, respectively.

As shown in FIG. 20, the metatarsophalangeal joint MP is located at a region of 60-80% from the heel rear end, in more detail, 64-72%, wherein the position of the heel rear end is 0%, the position of a toe-tip position is 100%. Therefore, as the position of the metatarsophalangeal joint MP, by adopting a medium value of those regions, the position of 68% from the heel rear end is employed. In FIG. 20, reference characters H, M, F indicate a heel portion, a midfoot portion, and a forefoot portion, respectively. The heel portion H designates a region from the heel rear end to the Chopart joint TT, the midfoot portion M designates a region from the Chopart joint TT to the Lisfranc joint LF, and the forefoot portion F designates a region from the Lisfranc joint LF to the toe-tip portion.

Turning back to FIG. 1, the curved plate P extends longitudinally generally along a curved shape of the top surface 20 of the upper midsole 2A along the sole body 1A. The curved plate P includes a downwardly convexly curved part $P_1$ that curves in a downward convex shape at the forefoot portion to the midfoot portion and a flat portion that extends in a generally flat shape (alternatively, an upwardly convexly curved part that curves in a gradually upwardly convex shape) $P_2$ at the midfoot portion to the heel portion. The sole bottom surface 21 has a downwardly convex shape 21*a* that curves in a downward convex shape in such a way as to rise to leave gradually from the ground toward the toe-tip end, which is a toe spring, and it also has a flat portion 21*b* that extends in a generally flat shape at the midfoot portion to the heel portion.

A shoe is structured by fixedly attaching an upper (not shown) through bonding or sewing on a top side of the sole 1. An outsole (not shown) of the sole 1 may be fixedly attached to the bottom surface 21 of the lower midsole 2B.

The upper and lower midsoles 2A, 2B are formed of a soft elastic material, more specifically, thermoplastic synthetic resin and its foamed resin such as ethylene-vinyl acetate copolymer (EVA) or the like, thermosetting synthetic resin and its foamed resin such as polyurethane (PU) or the like, alternatively, rubber material and foamed rubber such as butadiene rubber, chloroprene rubber or the like.

As shown in FIG. 1, the upper midsole 2A is colored in even gray from the heel portion to the toe portion, which indicates that the upper midsole 2A has a uniform compressive rigidity from the heel portion to the toe portion. In contrast, the lower midsole 2B is colored in even gray at the heel portion, which is the same color density as that of the upper midsole 2A, but the lower midsole 2B at the forefoot portion is colored in gray that is lighter than the heel portion (and thus, the upper midsole 2A). That means the compressive rigidity of the forefoot portion of the lower midsole 2B is relatively lower than the compressive rigidity of the heel portion (and the upper midsole 2A).

Here, the term, "compressive rigidity" is a concept that expresses a resistance to deformation relative to a compressive load. When the same compressive load is applied, a sole of a high compressive rigidity undergoes a small amount of deformation, whereas a sole of a low compressive rigidity undergoes a large amount of deformation. Therefore, the lower midsole 2B is softer on a forefoot-portion side and harder on a midfoot-portion side and a heel-portion side.

In other words, the sole body 1A has a sole forefoot top part $2A_1$ disposed above the curved plate P at the forefoot portion and a sole forefoot bottom part 2B; disposed below the curved plate P at the forefoot portion. The compressive rigidity of the sole body 1A is relatively lower at the sole forefoot bottom part $2B_1$. In addition, the compressive rigidity of the sole body 1A is relatively lower at least at the metatarsophalangeal joint (MP) position 20*j* (FIG. 3A) of the sole forefoot bottom part $2B_1$.

The curved plate P is a thin sheet-like member (see FIGS. 3E to 3G) and its thickness is for example, approximately 1-2 mm. In FIG. 1, for illustration purposes, the curved plate P is shown in a thick line. The curved plate P may have a ridged part (or a rib) Pb (see FIGS. 3E and 3F) that ridges upwardly in a crest shape and extends longitudinally at a generally laterally and longitudinally central part thereof. In this example shown in FIG. 1, a side surface of the curved plate P is seen at a side surface of the sole body 1A, but unlike that, the curved plate P may be built in the sole body 1A such that the side surface of the curved plate P is not seen at the side surface of the sole body 1A. Also, the curved plate P is adhered to boundary surfaces of the upper and lower midsoles 2A, 2B through bonding and the like. Alternatively, the curved plate P may be insert-molded in forming either one of the upper and lower midsoles 2A, 2B and thereafter it may be fixedly attached to the other of the upper and lower midsoles 2A, 2B.

The curved plate P may be formed of thermoplastic resin comparatively rich in elasticity such as thermos-plastic polyurethane (TPU), polyamide elastomer (PAE), acrylonitrile butadiene styrene resin (ABS) and the like, alternatively, thermosetting resin such as epoxy resin, unsaturated polyester resin and the like. Also, as a material for the curved plate P, fiber reinforced plastics (FRP) may be adopted in which carbon fibers, aramid fibers, glass fibers or the like are incorporated as a strengthened fiber, and thermosetting resin or thermoplastic resin is incorporated as matrix resin.

The outsole (not shown) is formed of a hard elastic material, more specifically, thermoplastic resin such as thermoplastic polyurethane (TPU), polyamide elastomer (PAE) and the like, thermosetting resin such as epoxy resin and the like, or solid rubber.

FIG. 2 shows a foot skeleton and a plantar aponeurosis in the state that a foot F of a wearer is placed on the sole 1 of FIG. 1, which is at the time of wearing the shoe. In FIG. 2, a reference character CC stands for a calcaneus, TL for talus, MT for metatarsus, PH for phalange, respectively. In the drawing, for illustration purposes, the talus TL is shown integrally with the calcaneus CC. Also, a reference character SA stands for a longitudinal arch of the foot and PF for a plantar aponeurosis. The plantar aponeurosis PF is a longitudinal fiber bundle that extends between the calcaneus CC and the phalange PH at the foot sole in a fan-shape as viewed from below.

Next, effects of the current embodiment will be explained using FIG. 3 in reference to FIGS. 1, 2 and 3A to 3G.

FIG. 3(*a*) shows a phase in which the sole 1 impacts onto the ground R at the forefoot portion. At this juncture, the sole forefoot bottom part $2B_1$ disposed below the curved plate P at the sole body 1A is in contact with the ground R.

FIG. 3(*b*) shows a phase in which a maximum load is imparted to the sole 1 after impacting of the sole 1 onto the ground R. At this time, as mentioned above, since the compressive rigidity of the sole body 1A is relatively lower at the sole forefoot bottom part $2B_1$ (preferably, at the metatarsophalangeal joint position), the sole forefoot bottom part $2B_1$ compressive-deforms relatively largely and thus the sole 1 sinks downwardly, as shown in FIG. 3(*b*).

Then, toes of the foot are largely bent and the plantar aponeurosis PF is stretched (see an open arrow mark in FIG. 3(*b*)), thereby elevating the arch SA, promoting a windlass action (that is, through bending of the toes, the arch SA is elevated to increase stiffness of the foot), and increasing a propulsion force during running. In this case, since the sole can promptly perform the windlass action at the time of impacting the ground at the forefoot portion, the timing for exerting the windlass action can be accelerated to correspond to a faster speed, thus increasing a running efficiency. Moreover, in this case, since the top surface 20*a* of the sole forefoot top part $2A_1$ disposed above the curved plate P is located at a position lowered from the top surface 20*b* of the sole midfoot top part $2A_2$ disposed above the curved plate P (see FIG. 1), a support angle relative to the foot of the shoe wearer becomes large, thus further increasing the running efficiency.

Also, after a ground contact of the sole 1, the heel portion is about to sink downwardly (see a downward arrow mark of FIG. 3(*b*)), but at this juncture, the curved plate P can support the heel portion thus decreasing the amount of drop/fall of the heel portion. In this case, in the event that the ridged part Pb is provided at the curved plate P (see FIGS. 3E, 3F), the rigidity of the curved plate P is increased thus further decreasing the amount of drop/fall of the heel portion. Moreover, when a load is imparted to the forefoot portion of the sole 1 and a downwardly convexly curved part $P_1$ on an anterior side of the curved plate P is pressed downwardly, through a seesaw action in which the curved plate P moves like a seesaw, an upwardly convexly curved part $P_2$ on a posterior side of the curved plate P is lifted upwardly (see an upward arrow mark of FIG. 3(*b*)). Thereby, in conjunction with a relative deformation of the sole forefoot bottom part $2B_1$, a supporting and elevating effect by the sole 1 can be enhanced at the midfoot region to the heel region of the foot, and a running efficiency can be improved following an elevation of the arch SA. In FIG. 3, the elevated arch SA is shown in a thick line. Also, in this case, since the sole forefoot part $2A_1$ is disposed above the curved plate P, a foot contact feeling can be improved and a push-up feeling relative to the foot sole can be relieved.

Here, FIG. 3B corresponds to FIG. 3(*b*), showing the sole top surface 20 in a solid line after an action of the maximum load. The sole top surface 20 prior to the action of the maximum load is shown in a dash-and-dot line. As shown in FIG. 3B, after the action of the maximum load, the metatarsophalangeal joint position 20*j* on the sole top surface 20 moves to the position 20*j*'. When a straight-line that connects the heel central position 20*h* and the metatarsophalangeal joint position 20*j* before the action of the maximum load is set to T and a straight-line that connects the heel central position 20*h* and the metatarsophalangeal joint position 20*j*' after the action of the maximum load is set to T'. Inclinations of the respective straight-lines T, T' relative to the ground stand for a support angle to the foot sole.

As shown in 3B, by the action of the maximum load, the inclination of the straight-line T' relative to the ground is greater than the inclination of the straight-line T relative to the ground, thus increasing a support angle relative to the foot sole. Thereby, a supporting and elevating effect can be further enhanced at the midfoot portion to the heel portion and the stiffness of the foot can be further increased to further improve a stability.

FIG. 3C is a side schematic view for explaining the state in which the midfoot portion lifts up relative to the forefoot portion (that is, pushed up) at the time of the action of the maximum load. In the drawing, a reference character Fs shows a foot sole of the shoe wearer. As shown in FIG. 3C, at the time of the action of the maximum load, as the forefoot portion sinks downwardly, the midfoot portion is relatively elevated and the foot sole Fs is lift up, thus allowing for following the elevation of the arch.

FIG. 3D is a side schematic view of the curved plate P for explaining a seesaw action of the curved plate P. As shown in FIG. 3D, when a pressing force is imparted to the downwardly convexly curved part $P_1$ on the anterior side (i.e. the left side in the drawing) of the curved plate P from the direction of an arrow mark $f_1$ and the downwardly convexly curved part $P_1$ is pressed downwardly, the curved plate P rotates in the direction of an arrow mark of Rv and thus the curved plate P acts like a seesaw, such that thereby the upwardly convexly curved part $P_2$ on the posterior side (i.e. the right side in the drawing) of the curved plate P is lifted up in the direction of an arrow mark of $f_2$. Thus, the amount of drop of the heel portion is decreased, and a supporting and elevating effect at the midfoot portion to the heel portion at the time of loading can be enhanced.

FIG. 3(*c*) shows a phase in which the toes are moved to the maximum bent state and a bent angle of the sole 1 becomes largest. At this juncture, as the plantar aponeurosis PF is further stretched (see an open arrow mark in the drawing), the arch SA is further lifted upwardly to further promote the windlass action. Also, as the curved plate P further performs the seesaw action, the supporting and elevating effect can be further enhanced at the midfoot portion to the heel portion.

FIG. 3(*d*) shows a phase immediately after a push-off motion of the toe portion of the sole 1, illustrating the phase in which the sole 1 leaves the ground R. In this case, through the windlass action, the stiffness of the foot portion is increased and a stability is improved, at the time of leaving the ground, a kick to the ground R can be increased and a running efficiency can be improved.

FIG. 3H is a top plan schematic view of the sole 1 and FIG. 3I is a longitudinal sectional schematic view of the sole 1 taken along line 3I-3I of FIG. 3H. In this exemplification, the bottom surface 21 of the lower midsole 2B (i.e., the sole bottom surface) does not extend in a generally flat shape at the midfoot portion to the heel portion, but it has a curved portion 21*b* that gradually extends upwardly toward the heel rear end side. In FIG. 3I, for illustration purposes, hatching is omitted. As shown in those drawings, at the forefoot portion of the sole body 1A, the sole forefoot bottom part $2B_1$ disposed below the curved plate P has a number of vertically extending holes (or vertical holes) 23 formed thereon. Preferably, relatively more holes 23 are formed at a position corresponding to the metatarsophalangeal (MP) joint position. Bottom ends of the respective holes 23 are not open at the sole bottom surface 21, and top ends of the respective holes 23 are open at boundary surfaces of the upper and lower midsoles 2, 3 and opening portions of the top ends are covered by the curved plate P. In this exemplification, the heel portion of the sole body 1A also has similar longitudinal holes 24 formed thereon, but the number of holes 24 is far less than that of the longitudinal holes 23 on the forefoot-portion side. Also, there are no longitudinal holes formed at the midfoot portion. By such constitution, the compressive-rigidity of the sole body 1A is relatively lower at the sole forefoot bottom part $2B_1$. In addition, a reference character 20*d* in the drawings designates an upraised portion that extends along and upwardly from an outer circumferential edge portion of the upper midsole 2A.

FIGS. 3J and 3K show a first alternative embodiment of FIGS. 3H and 3I. FIG. 3J is a top plan schematic view of the sole 1 and FIG. 3K is a longitudinal sectional schematic view of FIG. 3I taken along line 3K-3K. In this exemplification as well, the bottom surface 21 of the lower midsole 2B (or the sole bottom surface) does not extend in a generally flat shape at the midfoot portion to the heel portion, but it has a curved portion 21*b* that gradually extends upwardly toward the heel rear end side. In FIG. 3K, for illustration purposes, hatching is omitted. As shown in those drawing, at the forefoot portion of the sole body 1A, the sole forefoot bottom part 2B: disposed below the curved plate P has a number of vertically extending holes (or vertical holes) 23 formed thereon. Preferably, relatively more holes 23 are formed at a position corresponding to the metatarsophalangeal (MP) joint position. Bottom ends of the respective holes 23 are not open at the sole bottom surface 21, and top ends of the respective holes 23 are open at boundary surfaces of the upper and lower midsoles 2, 3 and opening portions of the top ends are covered by the curved plate P. In this exemplification, the midfoot portion of the sole body 1A also has similar longitudinal holes 24 formed thereon, but the number of holes 24 is far less than that of the longitudinal holes 23 on the forefoot-portion side. Also, there are no longitudinal holes formed at the heel portion. By such constitution, a compressive rigidity of the sole body 1A is relatively lower at the sole forefoot bottom part $2B_1$.

FIGS. 3L and 3M show a second alternative embodiment of FIGS. 3H and 3I. FIG. 3L is a top plan schematic view of the sole 1 and FIG. 3M is a longitudinal sectional schematic view of FIG. 3L taken along line 3M-3M. In this exemplification as well, the bottom surface 21 of the lower midsole 2B (or the sole bottom surface) does not extend in a generally flat shape at the midfoot portion to the heel portion, but it has a curved portion 21*b* that gradually extends upwardly toward the heel rear end side. In FIG. 3M, for illustration purposes, hatching is omitted. As shown in those drawings, there is provided a plate-like soft member 26 at the position corresponding to the metatarsophalangeal (MP) joint position at the sole forefoot bottom part $2B_1$ of the forefoot portion of the sole body 1A. The soft member 26 is accommodated in a concave portion formed on the top surface of the lower midsole 2B and covered by the curved plate P from above. The soft member 26 is such as, but not limited to a foamed rubber, foamed urethane or the like. During foam molding, a so-called bead-foaming may be adopted using beads as material. A hardness of the soft material may be approximately 20° C. of Asker C hardness. On the other hand, a hardness of the upper and lower midsoles 2A, 2B may be approximately 40° C. of Asker C hardness. By such a constitution, the compressive rigidity of the sole body 1A is relatively lower at the sole forefoot bottom part 2B: (especially, at the metatarsophalangeal (MP) joint position).

In FIGS. 3H to 3M, an example was shown in which the longitudinal holes 23 are formed at the sole forefoot bottom part $2B_1$, alternatively, the soft member 26 is provided at the sole forefoot bottom part $2B_1$, but the application of the present invention is not restricted to such an example. An expansion ratio of the sole body 1A may be relatively higher at the sole forefoot bottom part $2B_1$ to decrease the compressive rigidity of the sole forefoot bottom part $2B_1$.

FIGS. 3N and 3O show a third alternative embodiment of FIGS. 3H and 3I. In this embodiment, as shown in FIG. N, an opening portion 2Bh is formed at the sole forefoot bottom part 2B; and a shock absorber 30 is accommodated in the opening portion 2Bh.

As shown in FIG. 3O, the shock absorber 30 has a plurality of (in this example, six) shock absorbing parts 31 that are placed at a generally equal circumferential spacing from one another. The respective shock absorbing parts 31 have a top plate 31*a* and a bottom plate 31*b* that are spaced away from one another with a vertical distance, and a wall portion 31*c* that couples the top plate 31*a* to the bottom plate 31*b* in the vertical direction and that is elastically deformable in a circumferentially outward direction. The respective shock absorbing parts 31 are interconnected to one another through a coupling member 32 that is fitted to the respective wall portions 31*c* and disposed circumferentially.

When a downward load is imparted to the shock absorber 30, the top plates 31*a* of the shock absorbing parts 31 receive the load, the respective wall portions 31*c* elastically deform circumferentially outwardly and thus the top plates 31*a* move downwardly, such that thereby the sole forefoot bottom parts $2B_1$ deform to sink downwardly. By such constitution, the compressive rigidity of the sole body 1A is relatively lower at the sole forefoot bottom part $2B_1$.

Then, FIG. 3P is a side schematic view of a sole in which a sole forefoot top part has a different shape from that of the sole 1 of FIG. 1. In the sole 1 shown in FIG. 1, the sole top surface 20 has a downwardly concavely curved portion 20*a* formed in a concave shape at the forefoot portion and an upwardly convexly curved portion 20*b* formed in a gently convex shape (alternatively, a flat portion extending in a generally flat shape) at the midfoot portion to the heel portion. The top surface 20*a* of the sole forefoot top part $2A_1$ disposed above the curved plate P is located at a position below the top surface 20*b* of the sole midfoot top part $20A_2$ disposed above the curved plate P. But, the application of the present invention is not restricted to such an example.

In a sole 1 shown in FIG. 3P, there is not formed a concave portion at the forefoot portion and the sole top surface 20 is formed in a generally planar/flat shape at a region extending from the sole forefoot top part $2A_1$ to the sole midfoot top part $2A_2$.

In this case as well, since the compressive rigidity of the sole body 1A is relatively lower at the sole forefoot bottom portion $2B_1$, when a load acts, the sole forefoot bottom part $2B_1$ compressive-deforms relatively largely and the sole 1 sinks downwardly, such that thereby toes of a foot bend and the plantar aponeurosis is stretched, thus elevating the arch SA to promote a windlass action.

FIG. 3O shows the details of a more preferred shape of the sole 1 in FIG. 3P. As shown in FIG. 3Q, a straight-line that connects a position $S_0$ of the heel rear end (or the right end of the drawing) of the sole top surface 20 and a position Se of the toe-tip (or the left end of the drawing) is referred to as a reference line S. The sole top surface 20 coincides with a shape of a bottom surface of a last for use in an assembly of a shoe. Then, the position $S_0$ of the heel rear end is referred to as the origin O. A path length measured from the origin O along the sole top surface 20 to the position Se of the toe-tip is referred to as L. An intersecting point between the sole bottom surface 31 and a line orthogonal to the reference line S through the position 20*m* of (0.45×L) from the origin O along the sole top surface 20 is referred to as a ground-contact point C. In this exemplification, since an outsole 3 is provided at the bottom surface of the lower midsole 2B, the bottom surface 31 of the outsole 3 is referred to as a sole bottom surface. Also, in FIG. 3Q, an intersecting point between the reference line S and a line orthogonal to the reference line S through the position 20*m* is designated as Sp. When a sole posture in which the sole 1 is in contact with the ground R at the point C is defined as a sole reference posture, the sole bottom surface 31 is separated (or floated) from the ground R at the toe portion in the sole reference posture. More preferably, in the sole reference posture, at an anterior region from the metatarsophalangeal (MP) joint position 20*j* of (0.68×L) from the origin O along the sole top surface 20, the sole bottom surface 31 is separated from the ground.

Also, an angle (acute angle) θ is defined as an angle formed between the ground R and a straight-line T connecting a heel central position 20*h* of (0.15×L) from the origin O along the sole top surface 20 with the metatarsophalangeal joint position 20*j* of (0.68×L) from the origin O along the sole top surface 20. In the sole reference posture, the angle θ satisfies an inequality, 0≤5 [degrees].

In this case, in a phase of a ground contact of the sole 1, the sole 1 maintains the sole reference posture in which the sole 1 is in contact with the ground at the point C. At this juncture, since the sole bottom surface 31 at the toe portion (preferably, at an anterior region from the metatarsophalangeal joint position 20*j* of (0.68×L) from the origin O) is disposed separately (or floated) from the ground R, a natural forefoot running can be promoted.

Also, in the sole reference posture, the inequality, 0≤5 [degrees] is satisfied, wherein the angle (acute angle) θ is defined as an angle formed between the ground R and the straight-line T connecting the heel central position 20*h* of (0.15×L) from the origin O along the sole top surface 20 with the metatarsophalangeal joint position 20*j* of (0.68×L) from the origin O along the sole top surface 20. Thereby, the heel portion of the sole 1 is disposed above the forefoot portion (that is, a heel-up posture is attained), thus coinciding with the forefoot posture.

Here, the heel portion, the midfoot portion and the forefoot portion of the sole 1 are designated as follows (by using a path length L measured along the sole top surface 20 from the origin o to the toe-tip end position Se):

i) Heel portion: 0 to (0.25×L)

ii) Midfoot portion: (0.25×L) to (0.60×L)

iii) Forefoot portion: (0.60×L) to (1.00×L)

Second Embodiment

Figure 4:
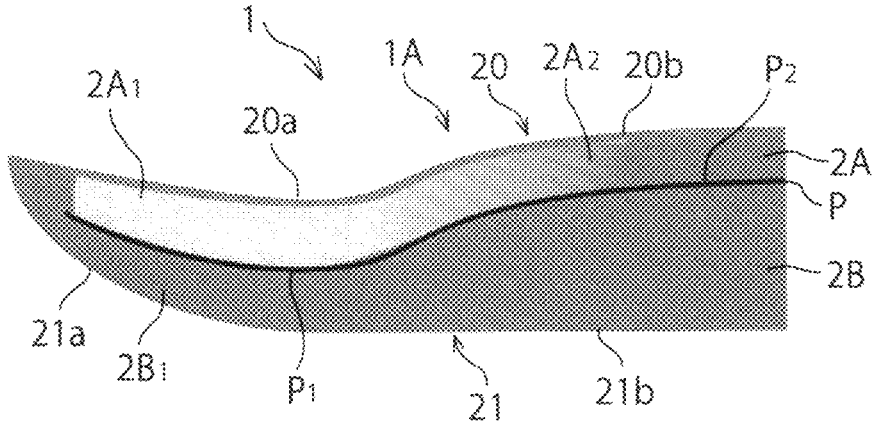
FIG. 4 is a side schematic view of a sole according to a second embodiment of the present invention.
Figure 5:
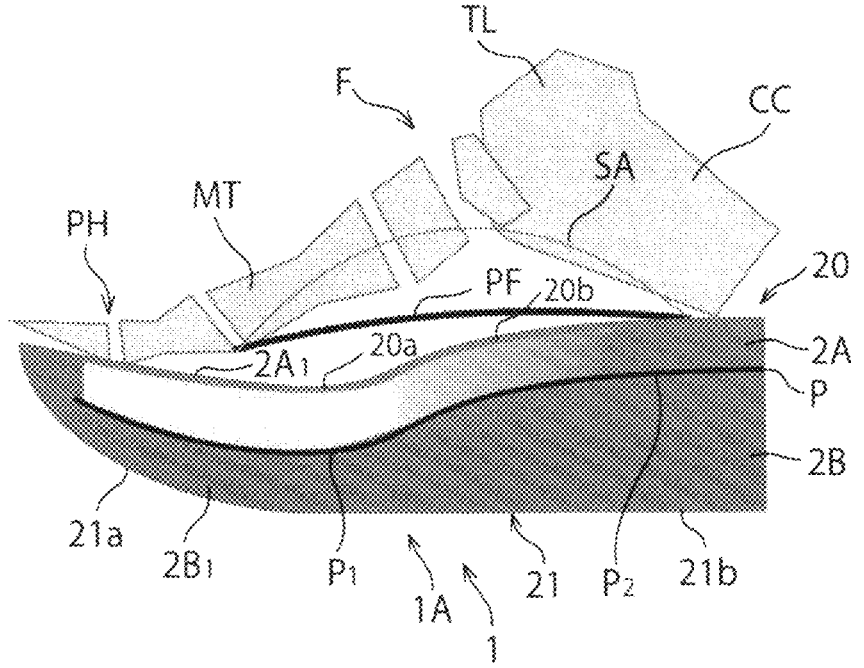
FIG. 5 shows the state of a foot skeleton and a plantar aponeurosis when a shoe wearer wears a shoe (an upper is not shown) incorporating the sole of FIG. 4.
Figure 6:
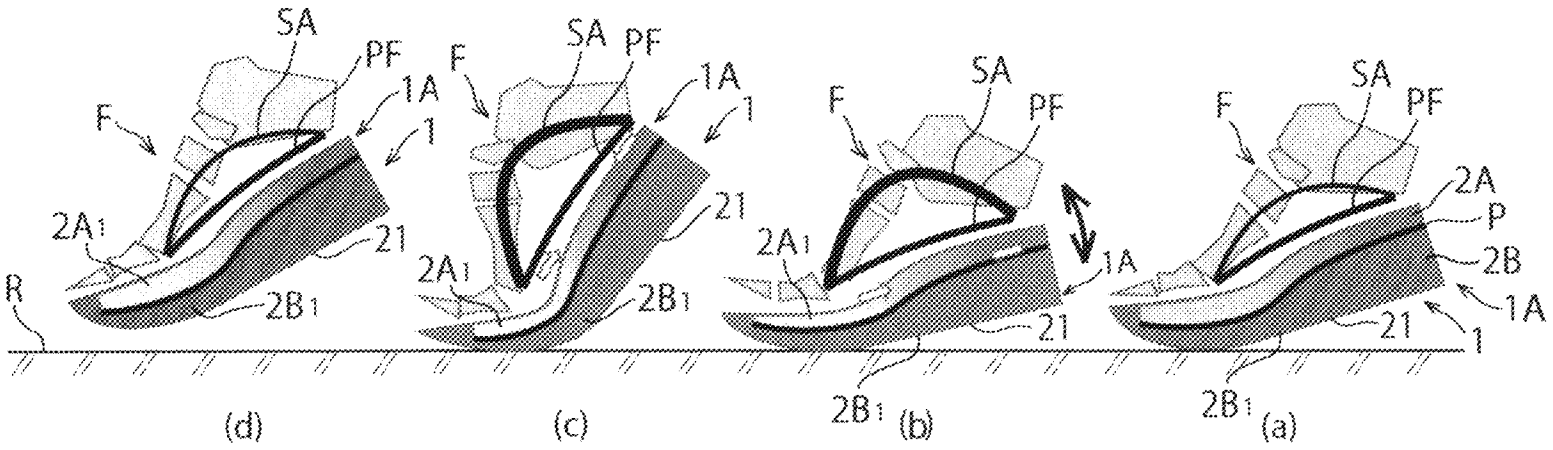
FIG. 6 shows the state of running of the shoe of FIG. 5, illustrating movements of the sole relative to the ground in the order from (a) to (d) in time-series manner

FIGS. 4 to 6 show a sole for a shoe (running shoe) according to a second embodiment of the present invention. In these drawings, like reference numbers indicate identical or functionally similar elements to those in the above-mentioned first embodiment.

In the first embodiment, an example was shown in which the rigidity of the sole body 1A is relatively lower at the sole forefoot bottom part 2$B_1$, but the application of the present invention is not restricted to such an example. In this second embodiment, as shown in FIG. 4, the lower midsole 2B is colored in even gray from the heel portion to the toe portion, which indicates that the lower midsole 2B has a uniform compressive rigidity from the heel portion to the toe portion. In contrast, the upper midsole 2A is colored in even gray at the heel portion, which is the same color density as that of the lower midsole 2B, but the upper midsole 2A at the forefoot portion is colored in gray that is lighter than the heel portion (and thus, the lower midsole 2B). That means the compressive rigidity of the sole body 1A at the sole forefoot top part 2$A_1$ (at least at the metatarsophalangeal joint position) is relatively lower than the compressive rigidity at other regions.

FIG. 5 shows a foot skeleton and a plantar aponeurosis in the state that a foot F of a wearer is placed on the sole 1 of FIG. 4 (that is, at the time of wearing the shoe and before action of a load), which corresponds to FIG. 2 of the above-mentioned first embodiment.

Next, effects of the second embodiment will be explained using FIG. 6 in reference to FIGS. 4, 5. FIG. 6(*a*) shows a phase in which the sole 1 impacts onto the ground R at the forefoot portion. At this juncture, the sole forefoot bottom part 2$B_1$ disposed below the curved plate P at the sole body 1A is in contact with the ground R.

FIG. 6(*b*) shows a phase in which a maximum load is imparted to the sole 1 after impacting of the sole 1 onto the ground R. At this time, as mentioned above, since the compressive rigidity of the sole body 1A is relatively lower at the sole forefoot top part 2$A_1$ (at least at the metatarsophalangeal joint position), the sole forefoot top part 2$A_1$ compressive-deforms relatively largely and the sole 1 thus sinks downwardly, as shown in FIG. 6(*b*).

Then, toes of the foot are largely bent and the plantar aponeurosis PF is stretched (see an open arrow mark in FIG. 6(*b*)), thereby elevating the arch SA, promoting a windlass action (that is, through bending of the toes, the arch SA is elevated to increase stiffness of the foot), and increasing a propulsion force during running. In this case, since the sole can promptly perform the windlass action at the time of impacting the ground at the forefoot portion, the timing for exerting the: windlass action can be accelerated to correspond to a faster speed, thus increasing a running efficiency. Moreover, in this case, since the top surface 20*a* of the sole forefoot top part 2$A_1$ disposed above the curved plate P is located at a position lowered from the top surface 20*b* of the sole midfoot top part 2$A_2$ disposed above the curved plate P (see FIG. 4), a support angle relative to the foot of the shoe wearer becomes large, thus further increasing a running efficiency.

Also, after a ground contact of the sole 1, the heel portion is about to sink downwardly (see a downward arrow mark in FIG. 6(*b*)), but at this juncture, the curved plate P can support the heel portion thus decreasing the amount of drop/fall of the heel portion. Moreover, when a load is imparted to the forefoot portion of the sole 1 and a downwardly convex curved part $P_1$ on an anterior side of the curved plate P is pressed downwardly, through a seesaw action in which the curved plate P moves like a seesaw, an upwardly convex curved part $P_2$ on a posterior side of the curved plate P is lifted upwardly (see an upward arrow mark in FIG. 6(*b*)). Thereby, in conjunction with a relative deformation of the sole forefoot top part 2$A_1$, a supporting and elevating effect by the sole 1 can be enhanced at the midfoot region to the heel region of the foot, and a running efficiency can be improved following an elevation of the arch SA. Also, in this case, since the soft sole forefoot part 2$A_1$ is disposed above the curved plate P, a foot contact feeling can be further improved and a push-up feeling relative to the foot sole can be further relieved.

Moreover, in this case as well, during action of a maximum load, since a supports angle relative to the foot sole becomes large, a supporting and elevating effect at the midfoot portion to the heel portion can be still further enhanced and a stiffness of the foot can be further increased thus further improving stability.

FIG. 6(*c*) shows a phase in which the toes are moved to the maximum bent state and a bent angle of the sole 1 becomes largest. At this juncture, as the plantar aponeurosis PF is further stretched (see an open arrow mark in the drawing), the arch SA is further lifted upwardly to further promote the windlass action. Also, as the curved plate P further performs the seesaw action, the supporting and elevating effect can be still further enhanced at the midfoot portion to the heel portion.

FIG. 6(*d*) shows a phase immediately after a push-off motion of the toe portion of the sole 1, illustrating the phase in which the sole 1 leaves the ground R. In this case, through the windlass action, since the stiffness of the foot portion is increased and stability is improved, at the time of leaving the ground, a kick to the ground R can be increased and a running efficiency can be improved.

In such a manner, in the second embodiment as well, as with the first embodiment, when the maximum load is applied, the forefoot portion of the sole 1 compressive-deforms to sink relatively largely, such that thereby the windlass action can be promoted and a supporting and elevating effect at the midfoot portion to the heel portion can be enhanced through the action of the curved plate P.

Third Embodiment

Figure 7:
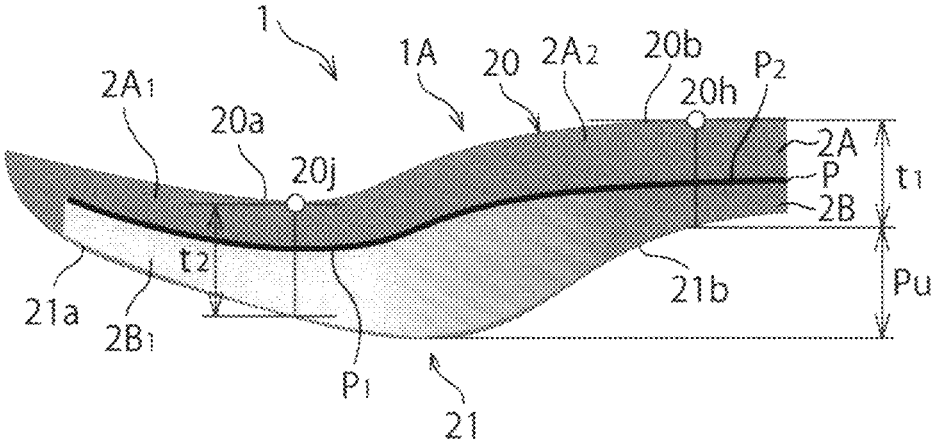
FIG. 7 is a side schematic view of a sole according to a third embodiment of the present invention.
Figure 8:
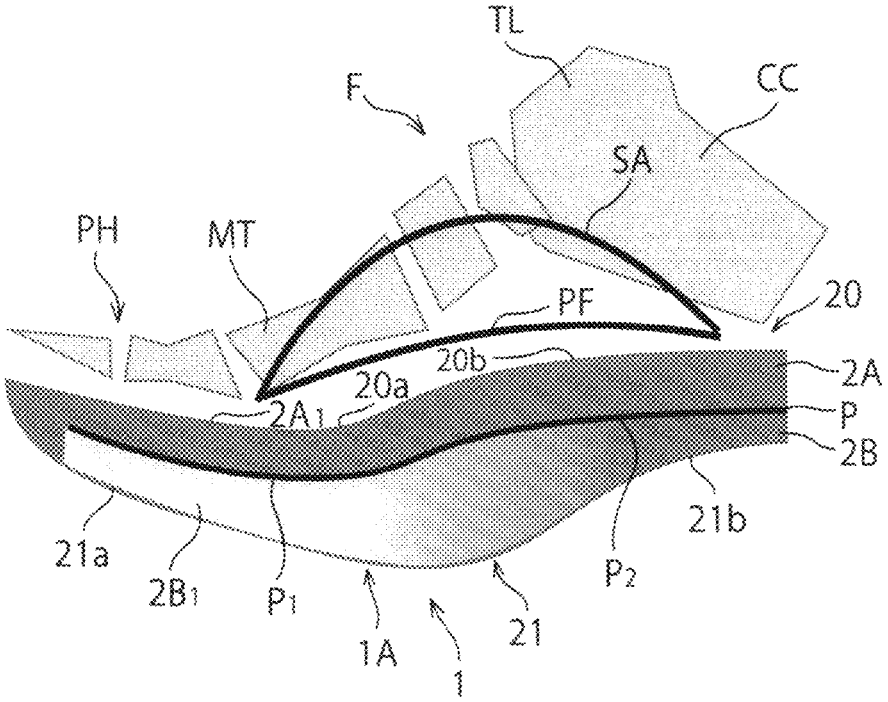
FIG. 8 shows the state of a foot skeleton and a plantar aponeurosis when a shoe wearer wears a shoe (an upper is not shown) incorporating the sole of FIG. 7.
Figure 9:
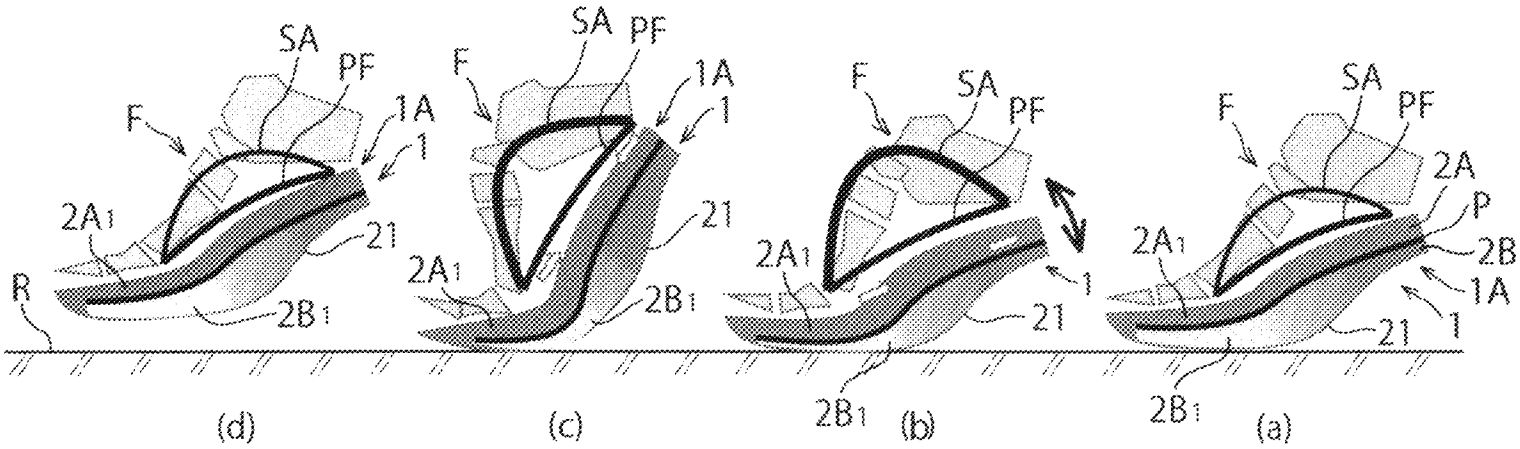
FIG. 9 shows the state of running of the shoe of FIG. 8, illustrating movements of the sole relative to the ground in the order from (a) to (d) in time-series manner

FIGS. 7 to 9 show a sole for a shoe (running shoe) according to a third embodiment of the present invention. In these drawings, like reference numbers indicate identical or functionally similar elements to those in the above-mentioned first and second embodiments.

In the first and second embodiments, an example was shown in which primarily, the bottom surface 21 of the lower midsole 2B (or the sole bottom surface) has a flat surface 21*b* that extends in a generally flat shape at a region from the midfoot portion to the heel portion (see FIGS. 1, 3A, 3P and 4), but the application of the present invention is not restricted to such an example.

In the third embodiment, as shown in FIG. 7, the bottom surface 21 of the lower midsole 2B (or the sole bottom surface) has a concavely curved portion 21*b* that extends upwardly in a concave shape at the midfoot portion to the heel portion. As a whole, the sole 1 extends curvedly in the longitudinal direction and the sole bottom surface 21 has a downwardly convexly round shape at the midfoot portion. Also, in this case, as shown in FIG. 7, when a thickness of the sole 1 at the heel central position 20*h* is referred to as $t_1$, and a thickness of the sole 1 at the metatarsophalangeal joint position 20*j* is referred to as $t_2$, $t_1=t_2$. That is, a drop or a difference of the thicknesses $t_1$, $t_2$ is zero. On the other hand, in designing a last, a heel height difference or a difference in height between the heel central position 20*h* and the metatarsophalangeal joint position 20*j* (i.e., PCup) is Pu. As can be seen from a density of gray colored in FIG. 7, in the third embodiment, similar to the first embodiment, the compressive rigidity of the forefoot portion of the lower midsole 2B is relatively lower at the sole forefoot bottom part $2B_1$ (at least at the metatarsophalangeal joint position 20*j*) compared to other regions.

FIG. 8 shows a foot skeleton and a plantar aponeurosis in the state that a foot F of a wearer is placed on the sole 1 of FIG. 7 (that is, at the time of wearing the shoe and before action of a load).

Next, effects of the third embodiment will be explained using FIG. 9 in reference to FIGS. 7, 8.

FIG. 9(*a*) shows a phase in which the sole 1 impacts onto the ground R at the forefoot portion. At this juncture, the sole forefoot bottom part 2B; disposed below the curved plate P at the sole body 1A is in contact with the ground R.

FIG. 9(*b*) shows a phase in which a maximum load is imparted to the sole 1 after impacting of the sole 1 onto the ground R. At this time, as mentioned above, since the compressive rigidity of the sole body 1A is relatively lower at the sole forefoot bottom part $2B_1$ (at least at the metatarsophalangeal joint position), the sole forefoot bottom part $2B_1$ compressive-deforms relatively largely and the forefoot portion of the sole 1 thus sinks downwardly, as shown in FIG. 9(*b*).

Then, toes of the foot are largely bent and the plantar aponeurosis PF is stretched (see an open arrow in FIG. 9(*b*)), thereby elevating the arch SA, promoting a windlass action (that is, through bending of the toes, the arch SA is elevated to increase stiffness of the foot), and increasing a propulsion force during running. In this case, since the sole can promptly perform the windlass action at the time of impacting the ground at the forefoot portion, the timing for exerting the windlass action can be accelerated to correspond to a faster speed, thus increasing a running efficiency. Moreover, in this case, since the top surface 20*a* of the sole forefoot top part 2A: disposed above the curved plate P is located at a position lowered from the top surface 20*b* of the sole midfoot top part $2A_2$ disposed above the curved plate P (see FIG. 7), a support angle relative to the foot sole of the shoe wearer becomes large, thus further increasing a running efficiency.

Also, after a ground contact of the sole 1, the heel portion is about to sink downwardly (see a downward arrow mark in FIG. 9(*b*)), but at this juncture, the curved plate P can support the heel portion thus decreasing the amount of drop/fall of the heel portion. Moreover, when a load is imparted to the forefoot portion of the sole 1 and a downwardly convexly curved part $P_1$ on an anterior side of the curved plate P is pressed downwardly, through a seesaw action in which the curved plate P moves like a seesaw, an upwardly convex curved part $P_2$ on a posterior side of the curved plate P is lifted upwardly (see an upward arrow mark in FIG. 9(*b*)). Thereby, in conjunction with a relative deformation of the sole forefoot top part $2A_1$, a supporting and elevating effect by the sole 1 can be enhanced at the midfoot region to the heel region of the foot, and a running efficiency can be improved following an elevation of the arch SA. Also, in this case, since the soft sole forefoot part $2A_1$ is disposed above the curved plate P, a foot contact feeling can be further improved and a push-up feeling relative to the foot sole can be further relieved.

Moreover, in this case as well, during action of a maximum load, since a support angle relative to a foot sole becomes large, a supporting and elevating effect at the midfoot portion to the heel portion can be still further enhanced and a stiffness of the foot can be further increased, thus further improving stability.

FIG. 9(*c*) shows a phase in which the toes are moved to the maximum bent state and a bent angle of the sole 1 becomes largest. At this juncture, as the plantar aponeurosis PF is further stretched (see an open arrow mark in the drawing), the arch SA is further lifted upwardly to further promote the windlass action. Also, as the curved plate P further performs the seesaw action, the supporting and elevating effect can be still further enhanced at the midfoot portion to the heel portion.

FIG. 9(*d*) shows a phase immediately after a push-off motion of the toe portion of the sole 1, illustrating the phase in which the sole 1 leaves the ground R. In this case, through the windlass action, since the stiffness of the foot portion is increased and stability is improved, at the time of leaving the ground, a kick to the ground R can be increased and a running efficiency can be improved.

In such a manner, in the third embodiment as well, as with the first and second embodiments, when the maximum load is applied, the forefoot portion of the sole 1 compressive-deforms to sink relatively largely, such that thereby the arch can be elevated, the windlass action can be promoted, and a supporting and elevating effect at the midfoot portion to the heel portion can be enhanced through the action of the curved plate P. Moreover, in the third embodiment, the concavely curved portion 21*b* is provided at the sole bottom surface 21*b* and thus the entire sole extends curvedly in the longitudinal direction, thus facilitating a maintenance of a forefoot running and further improving a running efficiency.

Fourth Embodiment

Figure 10:
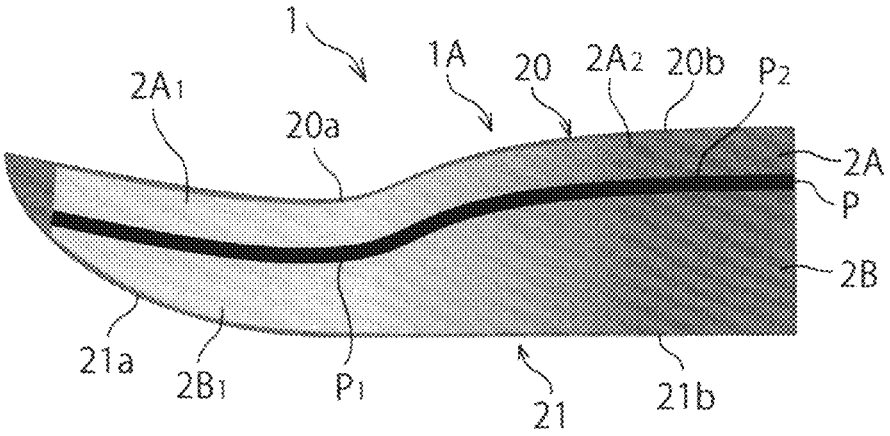
FIG. 10 is a side schematic view of a sole according to a fourth embodiment of the present invention.

FIG. 10 shows a sole for a shoe (running shoe) according to a fourth embodiment of the present invention. In the drawing, like reference numbers indicate identical or functionally similar elements to those in the above-mentioned first to third embodiments.

In the above-mentioned first to third embodiments, an example was shown in which the compressive rigidity of either one of the sole forefoot top part $2A_1$ and the sole forefoot bottom part $2B_1$ that are disposed above and below the curved plate P respectively is lower than the compressive rigidity of the other of the sole forefoot top part $2A_1$ and the sole forefoot bottom part 2B, but the application of the present invention is not restricted to such an example. As shown in FIG. 10, in the fourth embodiment, the compressive rigidity of both the sole forefoot top part $2A_1$ and the sole forefoot bottom part $2B_1$ is relatively lower than the compressive rigidity of a region other than the sole forefoot top part $2A_1$ and the sole forefoot bottom part $2B_1$. In this case, a relative sinking deformation at the sole forefoot portion can be further promoted.

Fifth Embodiment

Figure 11:
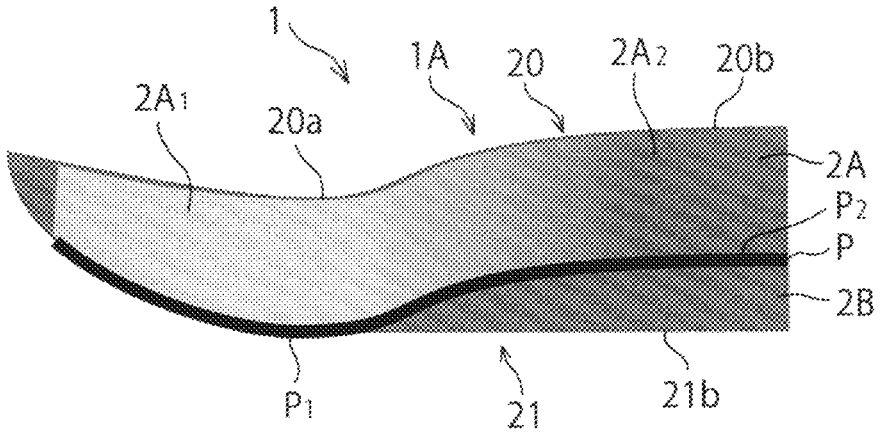
FIG. 11 is a side schematic view of a sole according to a fifth embodiment of the present invention.
Figure 12:
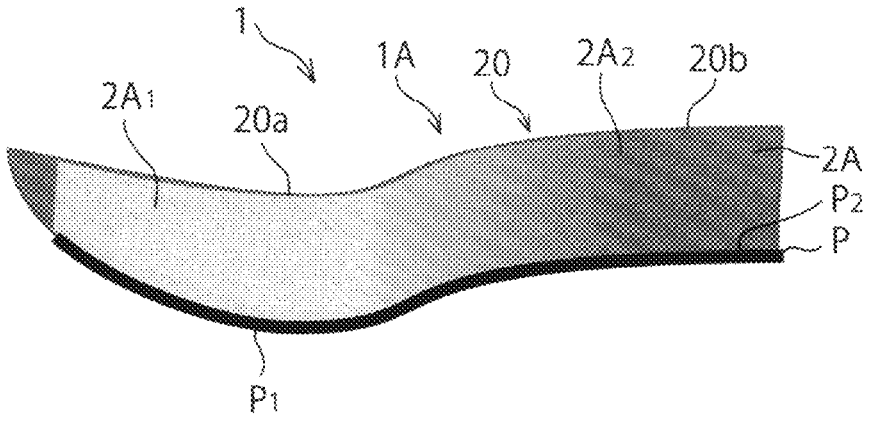
FIG. 12 is a side schematic view of a sole according to an alternative embodiment of the fifth embodiment of the present invention.

FIGS. 11 and 12 show a sole for a shoe (running shoe) according to a fifth embodiment of the present invention. In the drawings, like reference numbers indicate identical or functionally similar elements to those in the above-mentioned first to fourth embodiments.

In the above-mentioned first to fourth embodiments, an example was shown in which the sole forefoot top part $2A_1$ and the sole forefoot bottom part 2B; are respectively disposed above and below the curved plate P, but the application of the present invention is not restricted to such an example. As shown in FIGS. 11 and 12, in the fifth embodiment, the lower midsole 2B is not provided at the forefoot portion and only the upper midsole 2A is provided at the forefoot portion. Therefore, at the forefoot portion, only the sole forefoot top part 2A: is disposed above the curved plate P. The compressive rigidity of the sole forefoot top part $2A_1$ is relatively lower than the compressive rigidity of other regions. Additionally, FIG. 11 shows an example in which the lower midsole 2B is provided at the midfoot portion and the heel portion, but FIG. 12 shows another example, or an alternative embodiment of FIG. 11, in which the lower midsole 2B is not provided. In this fifth embodiment as well, a relative sinking deformation at the sole forefoot portion can be further promoted.

Sixth Embodiment

Figure 13:
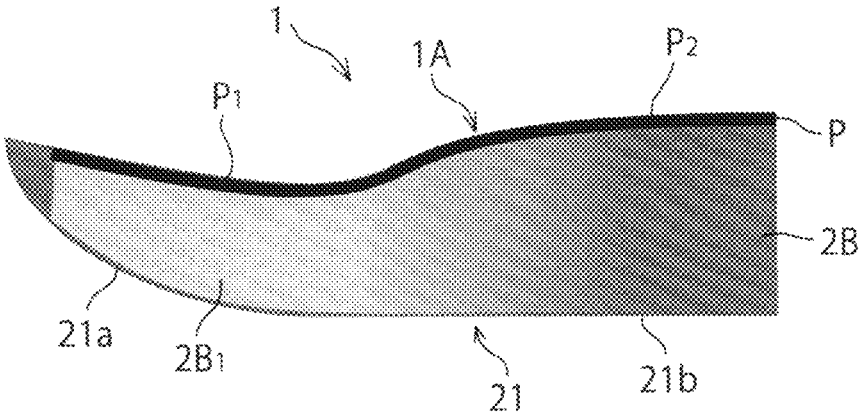
FIG. 13 is a side schematic view of a sole according to a sixth embodiment of the present invention.

FIG. 13 shows a sole for a shoe (running shoe) according to a sixth embodiment of the present invention. In the drawing, like reference numbers indicate identical or functionally similar elements to those in the above-mentioned first to fifth embodiments.

In the fifth embodiment, an example was shown in which only the upper midsole 2A is provided at the forefoot portion, but in this sixth embodiment, only the lower midsole 1B is provided at the forefoot portion and besides only the lower midsole 1B is provided at the midfoot portion and the heel portion as well. Therefore, at the forefoot portion, above the curved plate P, a sole forefoot top part is not provided and only the sole forefoot bottom part $2B_1$ is provided. The compressive rigidity of the sole forefoot bottom part $2B_1$ is relatively lower than the compressive rigidity at other regions. In this sixth embodiment as well, a relative sinking deformation at the sole forefoot portion can be further promoted.

Seventh Embodiment

Figure 14:
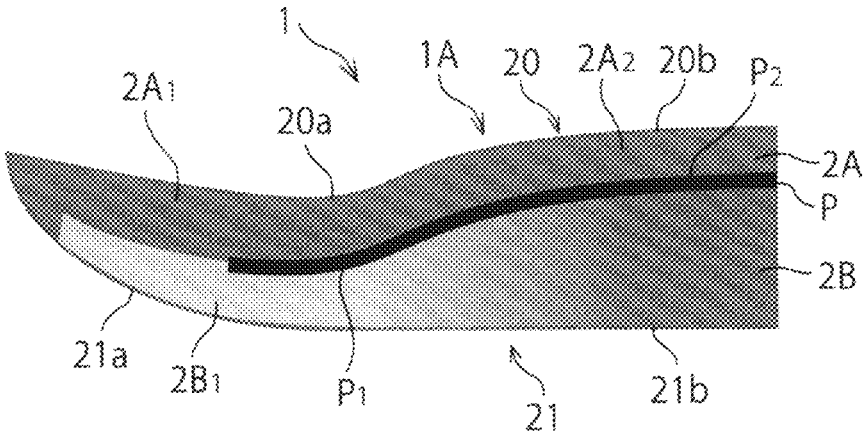
FIG. 14 is a side schematic view of a sole according to a seventh embodiment of the present invention.

FIG. 14 shows a sole for a shoe (running shoe) according to a seventh embodiment of the present invention. In the drawing, like reference numbers indicate identical or functionally similar elements to those in the above-mentioned first to sixth embodiments.

In the above-mentioned first to sixth embodiments, an example was shown in which the downwardly convexly curved portion $P_1$ of the curved plate P extends from the midfoot portion to the forefoot portion, but the application of the present invention is not restricted to such an example. The downwardly convexly curved portion $P_1$ of the curved plate P does not need to extend to the forefoot portion and may extend to a region from the heel portion to the midfoot portion. This seventh embodiment (as with an eighth to eleventh embodiment described later) shows an example of a sole having such a curved plate P.

As shown in FIG. 14, in the seventh embodiment, a curved shape and a disposition area of boundaries of the upper midsole 2A and the lower midsole 2B are similar to those in the first to fourth embodiments, and the sole forefoot top part $2A_1$ and the sole forefoot bottom part $2B_1$ are disposed at the forefoot portion. The compressive rigidity of the sole forefoot bottom part $2B_1$ is lower than the compressive rigidity of other regions. In this seventh embodiment as well, a relative sinking deformation at the sole forefoot portion can be further promoted. The seventh embodiment corresponds to FIG. 1 of the first embodiment but differs from FIG. 1 in that the curved plate P does not extend to the forefoot portion.

Eighth Embodiment

Figure 15:
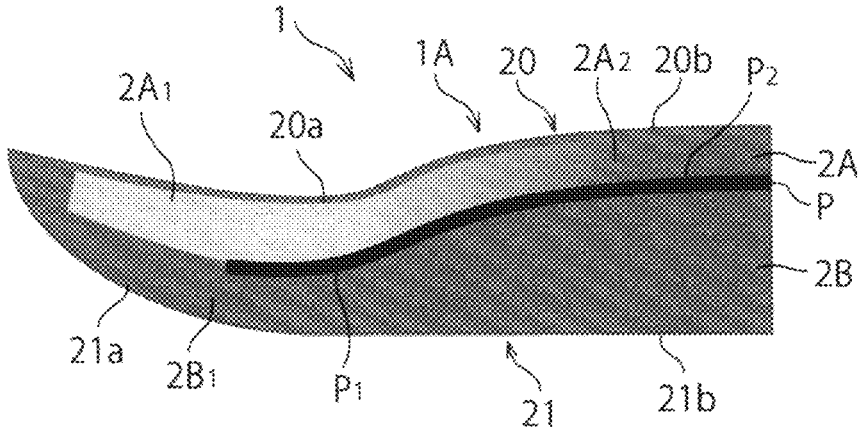
FIG. 15 is a side schematic view of a sole according to an eighth embodiment of the present invention.

FIG. 15 shows a sole for a shoe (running shoe) according to an eighth embodiment of the present invention. In the drawing, like reference numbers indicate identical or functionally similar elements to those in the above-mentioned first to seventh embodiments.

s shown in FIG. 15, in the eighth embodiment, a curved shape and a disposition area of boundaries of the upper midsole 2A and the lower midsole 2B are similar to those in the first to fourth and seventh embodiments, and the sole forefoot top part $2A_1$ and the sole forefoot bottom part $2B_1$ are disposed at the forefoot portion. The compressive rigidity of the sole forefoot top part $2A_1$ is lower than the compressive rigidity of other regions. In this eighth embodiment as well, a relative sinking deformation at the sole forefoot portion can be further promoted. The eighth embodiment corresponds to FIG. 4 of the second embodiment but differs from the second embodiment in that the curved plate P does not extend to the forefoot portion.

Ninth Embodiment

Figure 16:
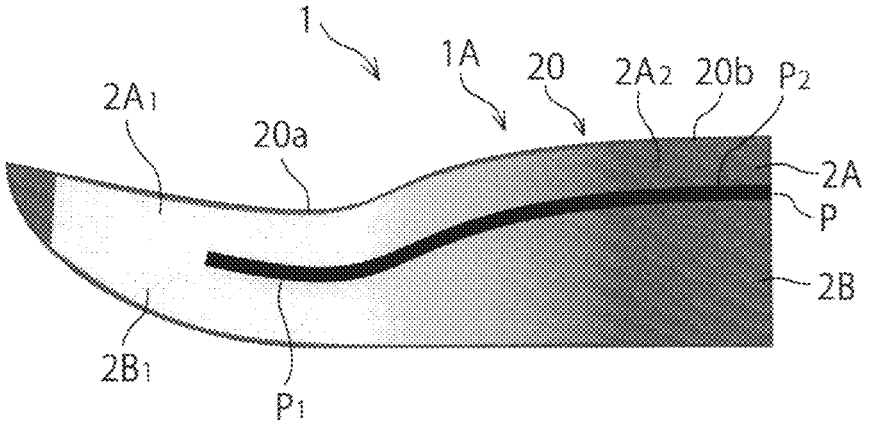
FIG. 16 is a side schematic view of a sole according to a ninth embodiment of the present invention.

FIG. 16 shows a sole for a shoe (running shoe) according to a ninth embodiment of the present invention. In the drawing, like reference numbers indicate identical or functionally similar elements to those in the above-mentioned first to eighth embodiments.

As shown in FIG. 16, in the ninth embodiment, a curved shape and a disposition area of boundaries of the upper midsole 2A and the lower midsole 2B are similar to those in the first to fourth and the seventh and eighth embodiments, and the sole forefoot top part $2A_1$ and the sole forefoot bottom part $2B_1$ are disposed at the forefoot portion. The compressive rigidity of the sole forefoot top part $2A_1$ and the sole forefoot bottom part $2B_1$ is lower than the compressive rigidity of other regions. In this ninth embodiment as well, a relative sinking deformation at the sole forefoot portion can be promoted. The ninth embodiment corresponds to FIG. 10 of the fourth embodiment but differs from the fourth embodiment in that the curved plate P does not extend to the forefoot portion.

Tenth Embodiment

Figure 17:
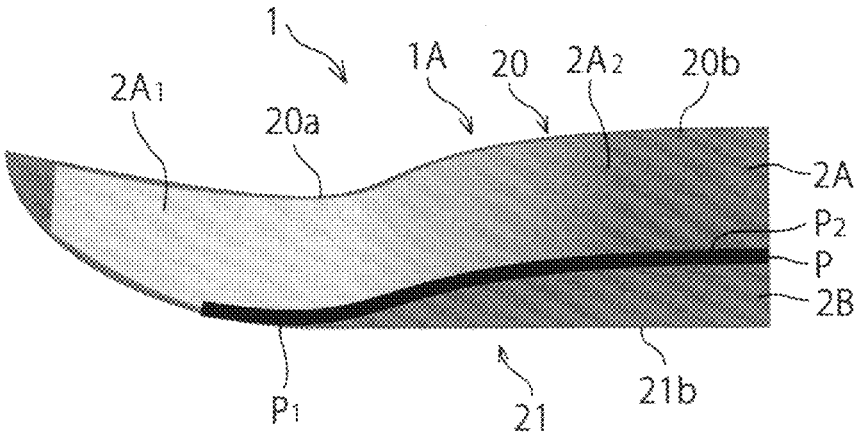
FIG. 17 is a side schematic view of a sole according to a tenth embodiment of the present invention.
Figure 18:
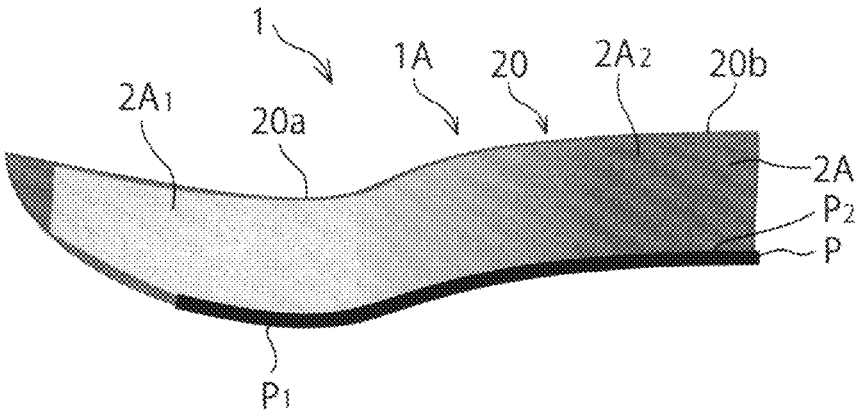
FIG. 18 is a side schematic view of a sole according to an alternative embodiment of the tenth embodiment of the present invention.

FIGS. 17 and 18 show a sole for a shoe (running shoe) according to a tenth embodiment of the present invention. In the drawings, like reference numbers indicate identical or functionally similar elements to those in the above-mentioned first to ninth embodiments.

FIGS. 17 and 18 respectively correspond to FIGS. 11, 12 of the fifth embodiment, but differs from the fifth embodiment in that the curved plate P does not extend to the forefoot portion. Therefore, the compressive rigidity of the sole forefoot top part $2A_1$ is lower than the compressive rigidity of other regions. In this tenth embodiment as well, a relative sinking deformation at the sole forefoot portion can be promoted.

Eleventh Embodiment

Figure 19:
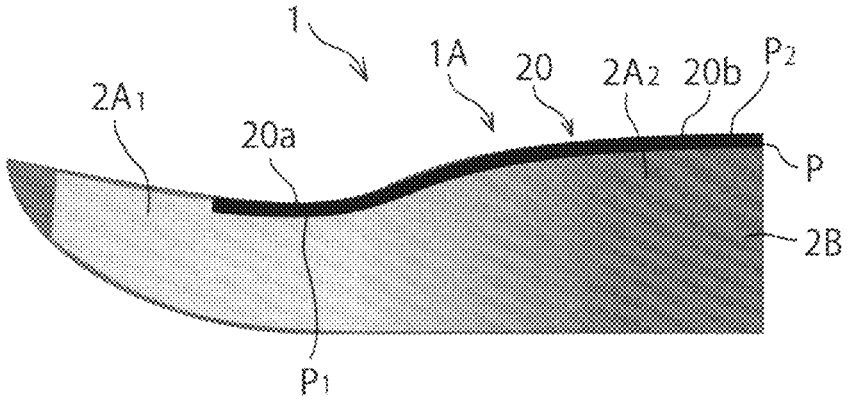
FIG. 19 is a side schematic view of a sole according to an eleventh embodiment of the present invention.

FIG. 19 shows a sole for a shoe (running shoe) according to an eleventh embodiment of the present invention. In the drawing, like reference numbers indicate identical or functionally similar elements to those in the above-mentioned first to tenth embodiments.

FIG. 19 corresponds to FIG. 13 of the sixth embodiment, but differs from the sixth embodiment in that the curved plate P does not extend to the forefoot portion. Therefore, the compressive rigidity of the sole forefoot bottom part $2B_1$ is lower than the compressive rigidity of other regions. In this eleventh embodiment as well, a relative sinking deformation at the sole forefoot portion can be promoted.

As mentioned above, the present invention is useful for a sole for a shoe that promotes a windlass action during loading, enhances a supporting and elevating effect at the midfoot portion to the heel portion, and improves a running efficiency.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole for a shoe, said sole incudes a heel portion, a midfoot portion and a forefoot portion, said sole comprising:

a sole body that extends longitudinally from said heel portion to a toe portion of said forefoot portion; and a curved plate that is provided at said sole body and that extends longitudinally along said sole body, wherein both said forefoot portion and said heel portion of said sole body have holes formed thereon to allow for a downward deformation of said forefoot portion and said heel portion that is larger relative to a downward deformation of said midfoot portion;

wherein a metatarsophalangeal joint position of said forefoot portion has more of said holes than other areas of the sole body such that a lowest compressive rigidity of said sole body is at said metatarsophalangeal joint position of said forefoot portion, where said compressive rigidity is a resistance to a deformation under a compressive load;

wherein said curved plate has a ridged part that extends longitudinally and that ridges upwardly in a crest shape to increase a bending rigidity of said curved plate;

whereby when a compressive load is applied to said sole at a time of a ground contact, said sole compressively-deforms a greatest amount at said metatarsophalangeal joint position of said sole body to elevate an arch of a foot of a shoe wearer to promote a windlass action.

2. The sole according to claim 1, wherein said sole body includes at least either a sole forefoot top part disposed above said curved plate at said forefoot portion or a sole forefoot bottom part disposed below said curved plate at said forefoot portion.

3. The sole according to claim 2, wherein said sole body includes said sole forefoot top part and said sole forefoot bottom part; and wherein said sole forefoot top part and said sole forefoot bottom part have one of the features selected from the group consisting of:

a first feature wherein, a compressive rigidity of said sole forefoot top part and said sole forefoot bottom part is lower than a compressive rigidity at a region other than said sole forefoot top part and said sole forefoot bottom part;

a second feature wherein, a compressive rigidity of said sole forefoot top part is lower than a compressive rigidity at a region other than said sole forefoot top part; and a third feature wherein, a compressive rigidity of said sole forefoot bottom part is lower than a compressive rigidity at a region other than said sole forefoot bottom part.

4. The sole according to claim 1, wherein said curved plate has a downwardly convexly curved part, and a flat part or an upwardly convexly curved part, wherein said downwardly convexly curved part curves in a downwardly convex shape from said forefoot portion to said midfoot portion, said flat part extends in a generally flat shape from said midfoot portion to said heel portion, and said upwardly convexly curved part curves gently in an upwardly convex shape from said midfoot portion to said heel portion.

5. The sole according to claim 1, wherein said sole body has a sole top surface and a sole bottom surface;

wherein a sole reference posture is defined as a sole posture in which a reference line is set to a straight line to connect a toe-tip position and a rearmost end position of said sole top surface, said rearmost end position is set to the origin, a path length measured along said sole top surface from the origin to said toe-tip position is set to L, an intersection point of said sole bottom surface and a line crossing a position of (0.45×L) from the origin along said sole top surface and orthogonal to said reference line is set to a ground-contact point, and said sole is in contact with the ground at said ground-contact point;

wherein in said sole reference posture, said sole bottom surface is separated from the ground at an anterior region from said metatarsophalangeal joint position of (0.68×L) from the origin along said sole top surface; and wherein when an angle θ is set between the ground and a straight line connecting a heel central position of (0.15×L) from the origin along said sole top surface with a metatarsophalangeal joint position of (0.68×L) from the origin along said sole top surface, in said sole reference posture, said angle θ is greater than or equal to 5 degrees.

6. The sole according to claim 1, wherein when the compressive load is applied to said sole at the time of the ground contact, said midfoot portion relatively rises upwardly due to said downward deformation of said forefoot portion and said heel portion, such that thereby said midfoot portion dynamically follows a contour of the arch of the foot to further promote said windlass action, and said midfoot portion can be fully supported by said curved plate to still further promote said windlass action.

* * * * *